US011800309B2

(12) United States Patent
Brännmark et al.

(10) Patent No.: US 11,800,309 B2
(45) Date of Patent: Oct. 24, 2023

(54) BASS MANAGEMENT IN AUDIO SYSTEMS

(71) Applicant: DIRAC RESEARCH AB, Uppsala (SE)

(72) Inventors: Lars-Johan Brännmark, Uppsala (SE); Jakob Ågren, Uppsala (SE); Frans Rosencrantz, Uppsala (SE)

(73) Assignee: DIRAC RESEARCH AB, Uppsala (SE)

( * ) Notice: Subject to any disclaimer, the term of this patent is extended or adjusted under 35 U.S.C. 154(b) by 139 days.

(21) Appl. No.: 17/620,591

(22) PCT Filed: Apr. 23, 2020

(86) PCT No.: PCT/SE2020/050409
§ 371 (c)(1),
(2) Date: Dec. 17, 2021

(87) PCT Pub. No.: WO2020/256612
PCT Pub. Date: Dec. 24, 2020

(65) Prior Publication Data

US 2022/0360926 A1 Nov. 10, 2022

Related U.S. Application Data

(60) Provisional application No. 62/864,373, filed on Jun. 20, 2019.

(51) Int. Cl.
*H04R 3/00* (2006.01)
*H04R 29/00* (2006.01)
(Continued)

(52) U.S. Cl.
CPC ..... *H04S 7/301* (2013.01); *H04R 1/24* (2013.01); *H04R 3/12* (2013.01); *H04R 29/001* (2013.01)

(58) Field of Classification Search
CPC ... H04R 3/00; H04R 3/04; H04R 3/12; H04R 3/14; H04R 1/20; H04R 1/24; H04R 5/00;
(Continued)

(56) References Cited

U.S. PATENT DOCUMENTS 8,280,076 B2 * 10/2012 Devantier ..... H04S 7/302 381/103
10,559,316 B2 * 2/2020 Cassidy ..... H03G 9/025
(Continued)

FOREIGN PATENT DOCUMENTS

EP 1 954 096 11/2010
EP 2 257 083 12/2010
(Continued)

OTHER PUBLICATIONS

International Search Report for PCT/SE2020/050409 dated Jun. 17, 2020, 6 pages.
(Continued)

*Primary Examiner* — Thang V Tran
(74) *Attorney, Agent, or Firm* — NIXON & VANDERHYE

(57) ABSTRACT

There is provided a method for controlling bass reproduction properties of a multichannel audio system, wherein the audio system has inputs for at least two audio input signals and includes a set of loudspeakers, including at least one bass-capable loudspeaker and at least two high-range loudspeakers, each loudspeaker being associated with a loudspeaker channel. The method includes obtaining impulse responses or transfer functions that represent the sound reproduction properties of each loudspeaker channel at a number of measurement or control positions. The method also includes tuning, when the audio system includes more than one bass-capable loudspeaker, loudspeaker channels of
(Continued)

at least two bass loudspeakers to each other so that their sum impulse response has minimum spatial variability, and/or controlling high-range loudspeaker speaker channels to be in-phase with each other and/or with bass-capable loudspeaker channel in a crossover frequency band.

20 Claims, 15 Drawing Sheets

(51) Int. Cl.
*H04S 7/00* (2006.01)
*H04R 1/24* (2006.01)
*H04R 3/12* (2006.01)

(58) Field of Classification Search
CPC . H04R 5/02; H04R 5/04; H04R 29/00; H04R 29/001; H04S 7/00; H04S 7/30; H04S 7/301; H04S 7/307
See application file for complete search history.

(56) References Cited

U.S. PATENT DOCUMENTS

| | | | | |
|---|---|---|---|---|
| 11,658,631 | B1 * | 5/2023 | Lim | H04R 29/00 375/345 |
| 2005/0031135 | A1 | 2/2005 | Devantier et al. | |
| 2005/0063554 | A1 * | 3/2005 | Devantier | H04S 7/302 381/98 |
| 2007/0025559 | A1 | 2/2007 | Mihelich et al. | |
| 2008/0025518 | A1 * | 1/2008 | Mizuno | H04S 3/002 381/17 |
| 2010/0290643 | A1 | 11/2010 | Mihelich et al. | |
| 2010/0305725 | A1 * | 12/2010 | Brannmark | H04S 7/301 700/94 |
| 2012/0224701 | A1 * | 9/2012 | Sakai | H04S 7/301 381/17 |
| 2017/0238118 | A1 * | 8/2017 | Bahne | H04S 7/301 700/94 |
| 2019/0208322 | A1 * | 7/2019 | Chapman | H04R 1/26 |

FOREIGN PATENT DOCUMENTS

| | | | | |
|---|---|---|---|---|
| EP | 3 509 320 | | 7/2019 | |
| EP | 3 557 887 | | 10/2019 | |
| JP | 3451022 | B2 * | 9/2003 | |
| WO | 2013/141768 | | 9/2013 | |
| WO | 2016/028199 | | 2/2016 | |
| WO | WO-2016028199 | A1 * | 2/2016 | H04R 3/12 |
| WO | 2020/081674 | | 4/2020 | |

OTHER PUBLICATIONS

Written Opinion of the ISA for PCT/SE2020/050409 dated Jun. 17, 2020, 8 pages.

* cited by examiner

BASS MANAGEMENT IN AUDIO SYSTEMS

This application is the U.S. national phase of International Application No. PCT/SE2020/050409 filed Apr. 23, 2020 which designated the U.S. and claims priority to U.S. 62/864,373 filed Jun. 20, 2019, the entire contents of which are hereby incorporated by reference.

TECHNICAL FIELD

The proposed technology generally relates to audio systems and audio processing, and more particularly to a method and system for configuring an audio system including an audio processing system to enable control of bass reproduction properties of the audio system, as well as a method and system for controlling the bass reproduction properties of a multichannel audio system, and an audio processing system as well as a corresponding overall audio system and a computer program and computer-program product.

BACKGROUND

Bass management refers to a process of configuring an audio system so that the bass content of the incoming signals is directed to the loudspeakers that are best suited for reproduction of low frequencies, while the remaining high-frequency content is directed to the loudspeakers originally intended for the respective input signals. The division of an input signal into high and low frequency components is generally performed by a pair of complementary high-pass and low-pass filters, called crossover filters. The aim of bass management is to ensure that all low frequency content, regardless of input channel, will be perceived by the listener even if some of the loudspeakers are lacking in low frequency capability. The frequency band referred to here as bass typically consists of a range from approximately 20 Hz up to approximately 80 Hz. The reason why bass management generally works is that sound in this frequency range provides very little or no directional information to human listeners, especially in spaces where the room modes dominate over the direct sound. Thus, the bass signal intended for one loudspeaker can be redirected to other speakers without significantly affecting the perceived direction of the reproduced sound. In general, the bass-capable loudspeakers, also referred to as bass loudspeakers or simply bass speakers, could be one or several of the main system loudspeakers, e.g., the main front stereo L/R pair if these are large enough, or they could be one or several subwoofers, or any combination of subwoofers and large main speakers.

The audible end result perceived by a listener depends not only on the capability of the individual loudspeakers, but also on the way that the loudspeakers interact acoustically with each other and with the room. In general, such loudspeaker and room interactions can be very complicated and cause undesirable interference phenomena that cannot be addressed by the standard signal re-routing. It would thus be desirable to extend the bass management concept, so that it provides a way of reducing the negative influence of such interference phenomena.

SUMMARY

It is a general object to provide new and improved developments with respect to audio systems and bass management.

It is a specific object to provide a method for configuring an audio system including an audio processing system to enable control of bass reproduction properties of the audio system.

Another object is to provide a system for configuring an audio system including an audio processing system to enable controlled bass reproduction properties of the audio system.

It is also a specific object to provide a method for controlling bass reproduction properties of a multichannel audio system.

It is another object to provide a system for controlling bass reproduction properties of a multichannel audio system.

Yet another object is to provide an audio processing system comprising such a system for controlling bass reproduction properties of a multichannel audio system.

Still another object is to provide a corresponding overall audio system.

It is also an object to provide a corresponding computer program and computer-program product.

These and other objects are met by embodiments of the proposed technology.

The proposed technology provides a method and system, as well as other aspects, for controlling the bass reproduction properties of a multichannel audio system.

According to a first aspect, there is provided a method for configuring an audio system including an audio processing system to enable control of bass reproduction properties of the audio system. The audio system has inputs for at least two audio input signals and comprises a set of loudspeakers, including at least one bass-capable loudspeaker and at least two high-range loudspeakers, each loudspeaker being associated with a loudspeaker channel. The method comprises a) obtaining impulse responses or transfer functions that represent the sound reproduction properties of each loudspeaker channel at a number of measurement or control positions; and b) determining parameters for audio processing blocks in said audio processing system based on said impulse responses or transfer functions. The method is further characterized in that the step of determining parameters for audio processing blocks in said audio processing system based on said impulse responses or transfer functions comprises at least one of:

i) determining, when the audio system includes more than one bass-capable loudspeaker, parameters for gain factors, delays and all-pass filters operating on signals connected to the bass-capable loudspeakers, by using a criterion function that measures and/or represents spatial variability of the frequency response of a sum of bass-capable speaker transfer functions in the bass region, and performing a parameter search over a search space of admissible gain, delay and filter parameters;

ii) determining parameters for all-pass filters operating on signals connected to at least one pair of high-range loudspeakers, by using a criterion function that measures and/or represents the magnitude of the sum of the transfer functions of the high-range loudspeakers in a crossover frequency band, and performing a parameter search over a search space of admissible filter parameters;

iii) determining parameters for all-pass filters operating on signals connected to at least one high-range loudspeaker and to one or more bass-capable loudspeakers, by using a criterion function that measures and/or represents the magnitude of the sum of the transfer functions of the high-range loudspeaker(s) and of a bass channel for the bass-capable speaker(s) in a crossover frequency band, and performing a parameter search over a search space of admissible filter parameters.

According to a second aspect, there is provided a system for configuring an audio system including an audio processing system to enable controlled bass reproduction properties of the audio system. The audio system has inputs for at least two audio input signals and comprises a set of loudspeakers, including at least one bass-capable loudspeaker and at least two high-range loudspeakers, each loudspeaker being associated with a loudspeaker channel. The system for configuring an audio system is configured to a) obtain impulse responses or transfer functions that represent the sound reproduction properties of each loudspeaker channel at a number of measurement or control positions; and b) determine parameters for audio processing blocks in said audio processing system based on said impulse responses or transfer functions, characterized in that the system for configuring an audio system is further configured to perform at least one of the following procedures:

i) determining, when the audio system includes more than one bass-capable loudspeaker, parameters for gain factors, delays and all-pass filters operating on signals connected to the bass-capable loudspeakers, by using a criterion function that measures and/or represents spatial variability of the frequency response of a sum of bass-capable speaker transfer functions in the bass region, and performing a parameter search over a search space of admissible gain, delay and filter parameters;

ii) determining parameters for all-pass filters operating on signals connected to at least one pair of high-range loudspeakers, by using a criterion function that measures and/or represents the magnitude of the sum of the transfer functions of the high-range loudspeakers in a crossover frequency band, and performing a parameter search over a search space of admissible filter parameters;

iii) determining parameters for all-pass filters operating on signals connected to at least one high-range loudspeaker and to one or more bass-capable loudspeakers, by using a criterion function that measures and/or represents the magnitude of the sum of the transfer functions of the high-range loudspeaker(s) and of a bass channel for the bass-capable speaker(s) in a crossover frequency band, and performing a parameter search over a search space of admissible filter parameters.

According to a third aspect, there is provided a method for controlling bass reproduction properties of a multichannel audio system. The audio system has inputs for at least two audio input signals and comprises a set of loudspeakers, including at least one bass-capable loudspeaker and at least two high-range loudspeakers, each loudspeaker being associated with a loudspeaker channel. The method comprises:

obtaining impulse responses or transfer functions that represent the sound reproduction properties of each loudspeaker channel at a number of measurement or control positions; and tuning, when the audio system includes more than one bass-capable loudspeaker, loudspeaker channels of at least two bass loudspeakers to each other so that their sum impulse response has minimum spatial variability, and/or controlling high-range loudspeaker speaker channels to be in-phase with each other and/or with bass-capable loudspeaker channel(s) in a crossover frequency band.

According to a fourth aspect, there is provided a system configured for controlling bass reproduction properties of an associated multichannel audio system. The audio system has inputs for at least two audio input signals and comprises a set of loudspeakers, including at least one bass-capable loudspeaker and at least two high-range loudspeakers, each loudspeaker being associated with a loudspeaker channel. The system configured for controlling bass reproduction properties is configured to obtain impulse responses or transfer functions that represent the sound reproduction properties of each loudspeaker channel at a number of measurement or control positions. The system configured for controlling bass reproduction properties is also configured to tune, when the audio system includes more than one bass-capable loudspeaker, loudspeaker channels of at least two bass loudspeakers to each other so that their sum impulse response has minimum spatial variability, and/or control high-range loudspeaker speaker channels to be in-phase with each other and/or with bass-capable loudspeaker channel(s) in a crossover frequency band.

According to a fifth aspect, there is provided an audio processing system comprising a system configured for controlling bass reproduction properties of an associated multichannel audio system as described herein.

According to a sixth aspect, there is also provided an audio system comprising such an audio processing system.

According to a seventh aspect, there is provided a computer program comprising instructions, which when executed by a processor, cause the processor to perform any of the methods described herein.

According to an eighth aspect, there is provided a computer-program product comprising a non-transitory computer-readable medium having stored thereon such a computer program.

Expressed slightly differently, the proposed technology provides a method and system, and other aspects, for automatic fine-tuning of delays, gains and/or phase shifts in the bass region of each loudspeaker channel, resulting in an improved overall bass performance.

By way of example, a beneficial feature of the invention is that it strives to minimize seat-to-seat transfer function variations at low frequencies in systems with multiple bass-capable loudspeakers, e.g., subwoofers. Another advantageous feature is that it may control and/or ensure high-range main channels to be in-phase with each other and/or with the bass-capable speaker(s) (e.g. subwoofers) in the crossover frequency band, at a selected subset of measurement or control positions in the room.

Yet another interesting feature is that it may utilize impulse responses or transfer functions that represent the sound reproduction properties of each loudspeaker channel at a number of measurement or control positions in the room. For example, the impulse responses or transfer functions may be acquired through measurements in the room or through simulations based on a model of the room.

In a particular example, the design objectives may be addressed by adjusting the phase relationships between loudspeaker channels, using gain and delay adjustments and/or low-order digital filters applied to the channels, and a search algorithm for obtaining the parameters for said gains, delays and filters.

In this way, it is possible to provide improved overall bass performance for an audio system.

Other advantages will be appreciated when reading the following detailed description of non-limiting embodiment of the invention.

BRIEF DESCRIPTION OF DRAWINGS

The embodiments, together with further objects and advantages thereof, may best be understood by making reference to the following description taken together with the accompanying drawings, in which:

FIG. 5 (*a*) is the frequency response of the left speaker and FIG. 5 (*b*) is the frequency response of the right speaker.

FIG. 6 (*a*) is the sum response without all-pass filters applied to the loudspeaker signals. FIG. 6 (*b*) is the sum response after all-pass filters, designed according to the method of the present invention, have been applied to the loudspeaker signals.

FIG. 8 (*a*) shows the acoustic sum without any extra preprocessing of the speaker signals. FIG. 8 (*b*) shows the acoustic sum when the speaker signals have been preprocessed with all-pass filters designed according to the method of the present invention.

DETAILED DESCRIPTION

Throughout the drawings, the same reference designations are used for similar or corresponding elements.

Figure 1:
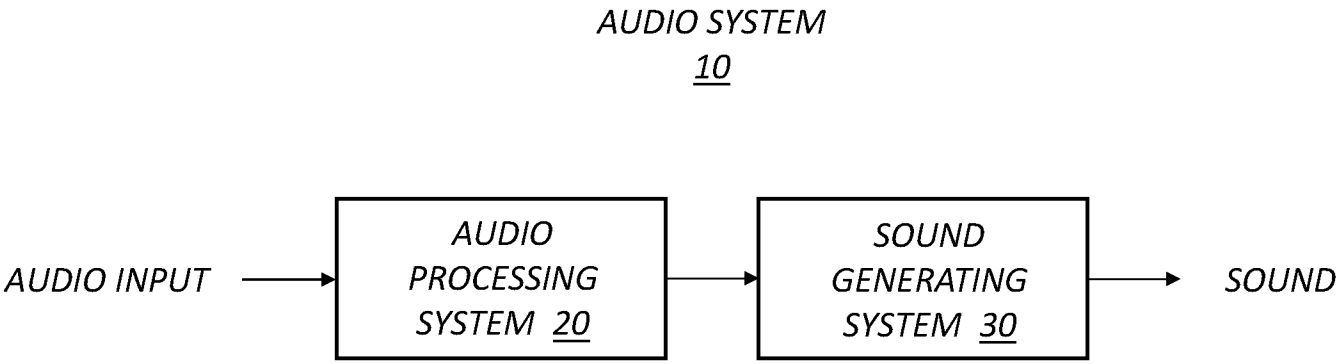
FIG. 1 is a schematic block diagram illustrating a simplified example of an audio system.

It may be useful to start with an audio system overview with reference to FIG. 1, which illustrates a simplified audio system. The audio system 10 basically comprises an audio processing system 20 and a sound generating system 30. In general, the audio processing system 20 is configured to process one or more audio input signals which may relate to one or more audio channels. The filtered audio signals are forwarded to the sound generating system 30 for producing sound. The sound generating system 30 may include a set of loudspeakers such as one or more bass-capable loudspeakers and two or more high-range loudspeakers.

As mentioned in the background section, bass management may refer to a method and/or process of configuring an audio system so that the bass content of the incoming signals is directed to the loudspeakers that are best suited for reproduction of low frequencies, while the remaining high-frequency content is directed to the loudspeakers originally intended for the respective input signals. The division of an input signal into high and low frequency components is generally performed by a pair of complementary high-pass and low-pass filters, called crossover filters. The aim of bass management is to ensure that all low frequency content, regardless of input channel, will be perceived by the listener even if some of the loudspeakers are lacking in low frequency capability. The frequency band referred to here as bass typically consists of a range from approximately 20 Hz up to approximately 80 Hz. The reason why bass management generally works is that sound in this frequency range provides very little or no directional information to human listeners, especially in spaces where the room modes dominate over the direct sound. Thus, the bass signal intended for one loudspeaker can be redirected to other speakers without significantly affecting the perceived direction of the reproduced sound. In general, the bass-capable loudspeakers could be one or several of the main system loudspeakers, e.g., the main front stereo L/R pair if these are large enough, or they could be one or several subwoofers, or any combination of subwoofers and large main speakers.

According to the above description, bass management may involve a re-routing of the input signals, in a way that takes the bass capability of the various loudspeakers into account. However, the audible end result perceived by a listener depends not only on the capability of the individual loudspeakers, but also on the way that the loudspeakers interact acoustically with each other and with the room. In general, such loudspeaker and room interactions can be very complicated and cause undesirable interference phenomena that cannot be addressed by the standard signal re-routing. It would thus be desirable to extend the bass management concept, so that it provides a way of reducing the negative influence of such interference phenomena.

The proposed technology provides a method and system, as well as other aspects, for controlling the bass reproduction properties of a multichannel audio system. The system for controlling the bass reproduction properties of a multichannel audio system is also referred to as an audio processing system. The proposed technology also provides a method and corresponding system for configuring such a multichannel audio system, including the audio processing system and processing blocks thereof, to enable control of the bass reproduction properties. The present invention can also be regarded as a method and system for automatic fine-tuning of delays, gains and phase shifts in the bass region of each loudspeaker channel, resulting in an improved overall bass performance.

Figure 14:
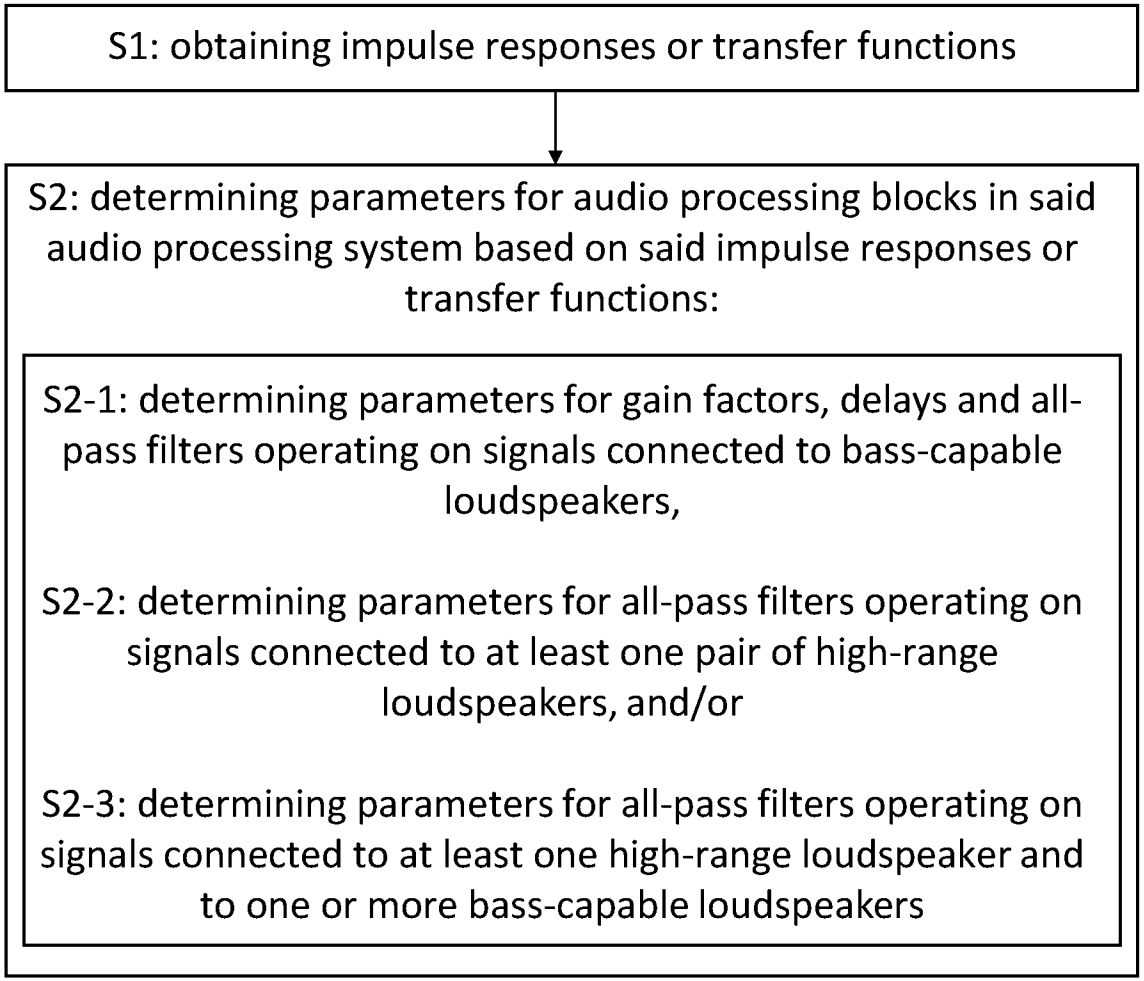
FIG. 14 is a schematic flow diagram illustrating an example of a method for configuring an audio system including an audio processing system to enable control of bass reproduction properties of the audio system.

FIG. 14 is a schematic flow diagram illustrating an example of a method for configuring an audio system including an audio processing system to enable control of bass reproduction properties of the audio system.

According to a first aspect, there is provided a method for configuring an audio system including an audio processing system to enable control of bass reproduction properties of the audio system.

The audio system has inputs for at least two audio input signals and comprises a set of loudspeakers, including at least one bass-capable loudspeaker and at least two high-range loudspeakers, each loudspeaker being associated with a loudspeaker channel.

The method comprises:

a) obtaining S1 impulse responses or transfer functions that represent the sound reproduction properties of each loudspeaker channel at a number of measurement or control positions; and b) determining S2 parameters for audio processing blocks in said audio processing system based on said impulse responses or transfer functions.

The method is further characterized in that the step S2 of determining parameters for audio processing blocks in said audio processing system based on said impulse responses or transfer functions comprises at least one of:

i) determining S2-1, when the audio system includes more than one bass-capable loudspeaker, parameters for gain factors, delays and all-pass filters operating on signals connected to the bass-capable loudspeakers, by using a criterion function that measures and/or represents spatial variability of the frequency response of a sum of bass-capable speaker transfer functions in the bass region, and performing a parameter search over a search space of admissible gain, delay and filter parameters;

ii) determining S2-2 parameters for all-pass filters operating on signals connected to at least one pair of high-range loudspeakers, by using a criterion function that measures and/or represents the magnitude of the sum of the transfer functions of the high-range loudspeakers in a crossover frequency band, and performing a parameter search over a search space of admissible filter parameters;

iii) determining S2-3 parameters for all-pass filters operating on signals connected to at least one high-range loudspeaker and to one or more bass-capable loudspeakers, by using a criterion function that measures and/or represents the magnitude of the sum of the transfer functions of the high-range loudspeaker(s) and of a bass channel for the bass-capable speaker(s) in a crossover frequency band, and performing a parameter search over a search space of admissible filter parameters.

By way of example, the parameters are determined to control, when the audio system includes more than one bass-capable loudspeaker, loudspeaker channels of at least two bass loudspeakers to be tuned to each other so that their sum impulse response has minimum spatial variability, and/or to control high-range loudspeaker speaker channels to be in-phase with each other and/or with bass-capable loudspeaker channel(s) in the crossover frequency band at a selected subset of measurement or control positions.

Optionally, step i) is executed when the audio system includes more than one bass-capable loudspeaker, step ii) and/or step iii) is/are executed for each stereo pair of high-range loudspeakers, and/or step iii) is executed for each non-paired high-range loudspeaker.

For example, at least a subset of said admissible gain and/or delay and/or filter parameters are encoded into the form of a binary string and said parameter search over said search space of said admissible parameters is performed using a genetic search algorithm.

As an example, the method further comprises implementing the determined parameters into audio processing blocks of the audio processing system.

In a particular example, the method comprises configuring audio processing blocks for bass-capable loudspeakers.

For example, the method comprises configuring an all-pass filter, a gain factor and a delay in the signal path of each bass-capable loudspeaker.

In a particular example, the method comprises configuring audio processing blocks for each pair of high-range loudspeakers.

For example, the method comprises configuring an all-pass filter in the signal path of each high-range loudspeaker in a considered loudspeaker pair.

Optionally, the method comprises configuring audio processing blocks for a bass-capable loudspeaker and high-range loudspeaker combination.

By way of example, the method comprises configuring all-pass filters in a signal path of each high-range loudspeaker in a selected loudspeaker pair and in a signal path associated with the input to a bass-capable loudspeaker channel.

In a particular example, the crossover frequency band is a frequency band in the crossover between the bass region and high range.

By way of example, at least one loudspeaker is capable of reproducing frequencies below 200 Hz, referred to as bass-capable loudspeaker(s), and at least one loudspeaker is capable of reproducing frequencies above 200 Hz, referred to as high-range loudspeaker(s).

For example, a bass region frequency band may include a range from approximately 20 Hz up to approximately 80 Hz.

In a particular example, the audio processing system is based on pair of complementary low-pass and high-pass filters, called crossover filters, for dividing each audio input signal into low and high frequency components, and a number of additional audio processing blocks.

For example, a cutoff frequency of the crossover filters may be around 75 Hz.

In a particular example embodiment, the method comprises determining parameter values that produce a reduced spatial variability of the frequency response of the sum of the bass-capable loudspeaker transfer functions, as measured by a variability criterion function, when said all-pass filters, delays and gain factors are applied to the bass-capable loudspeaker input signals.

As an example, the variability criterion function includes a weighted sum of several terms, each term measuring a specific aspect of the spatial variability of processed versions of the acquired transfer functions, for a set of frequencies in a selected frequency band in a bass region.

For example, the impulse responses or transfer functions may be acquired through measurements in a room or defined space or through simulations based on a model of the room or the defined space.

According to a second aspect, there is provided a system for configuring an audio system including an audio processing system to enable controlled bass reproduction properties of the audio system.

The audio system has inputs for at least two audio input signals and comprises a set of loudspeakers, including at least one bass-capable loudspeaker and at least two high-range loudspeakers, each loudspeaker being associated with a loudspeaker channel.

The system for configuring an audio system is configured to a) obtain impulse responses or transfer functions that represent the sound reproduction properties of each loudspeaker channel at a number of measurement or control positions; and b) determine parameters for audio processing blocks in said audio processing system based on said impulse responses or transfer functions, characterized in that the system for configuring an audio system is further configured to perform at least one of the following procedures:

i) determining, when the audio system includes more than one bass-capable loudspeaker, parameters for gain factors, delays and all-pass filters operating on signals connected to the bass-capable loudspeakers, by using a criterion function that measures and/or represents spatial variability of the frequency response of a sum of bass-capable speaker transfer functions in the bass region, and performing a parameter search over a search space of admissible gain, delay and filter parameters;

ii) determining parameters for all-pass filters operating on signals connected to at least one pair of high-range loudspeakers, by using a criterion function that measures and/or represents the magnitude of the sum of the transfer functions of the high-range loudspeakers in a crossover frequency band, and performing a parameter search over a search space of admissible filter parameters;

iii) determining parameters for all-pass filters operating on signals connected to at least one high-range loudspeaker and to one or more bass-capable loudspeakers, by using a criterion function that measures and/or represents the magnitude of the sum of the transfer functions of the high-range loudspeaker(s) and of a bass channel for the bass-capable speaker(s) in a crossover frequency band, and performing a parameter search over a search space of admissible filter parameters.

As an example, the system for configuring an audio system may be configured to implement the determined parameters into audio processing blocks of the audio processing system.

In a particular example, the system for configuring an audio system comprises at least one processor and memory, the memory comprising instructions, which when executed by the at least one processor, cause the at least one processor to obtain impulse responses or transfer functions and determine parameters for audio processing blocks based on said impulse responses or transfer functions.

Figure 15:
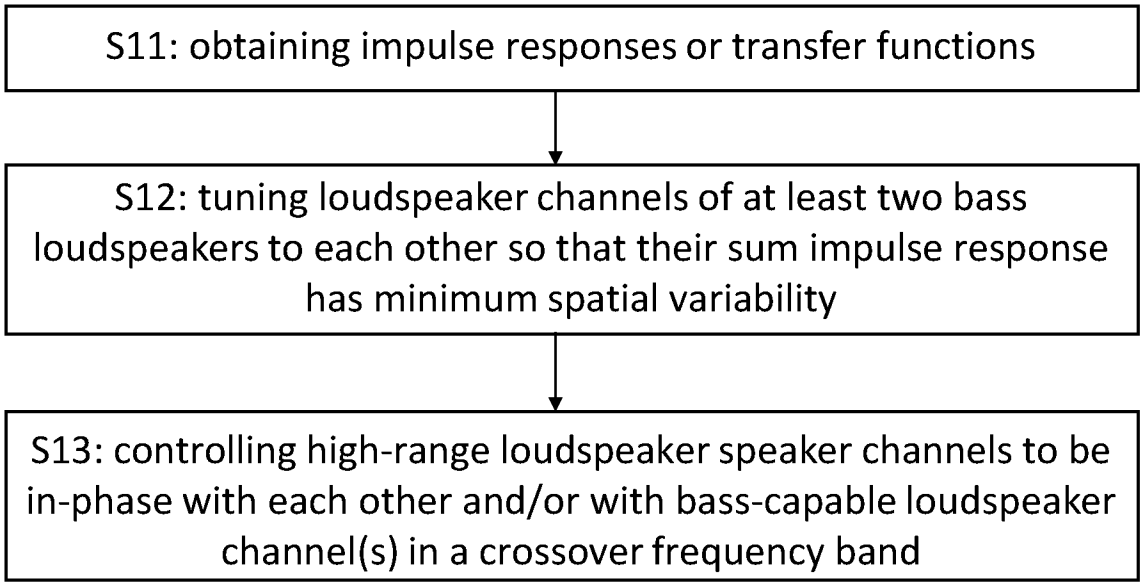
FIG. 15 is a schematic flow diagram illustrating an example of a method for controlling bass reproduction properties of a multichannel audio system.

FIG. 15 is a schematic flow diagram illustrating an example of a method for controlling bass reproduction properties of a multichannel audio system.

According to a third aspect, there is provided a method for controlling bass reproduction properties of a multichannel audio system.

The audio system has inputs for at least two audio input signals and comprises a set of loudspeakers, including at least one bass-capable loudspeaker and at least two high-range loudspeakers, each loudspeaker being associated with a loudspeaker channel.

The method comprises:

obtaining S11 impulse responses or transfer functions that represent the sound reproduction properties of each loudspeaker channel at a number of measurement or control positions; and tuning S12, when the audio system includes more than one bass-capable loudspeaker, loudspeaker channels of at least two bass loudspeakers to each other so that their sum impulse response has minimum spatial variability, and/or controlling S13 high-range loudspeaker speaker channels to be in-phase with each other and/or with bass-capable loudspeaker channel(s) in a crossover frequency band.

In a particular example, the method comprises adjusting phase relationships between loudspeaker channels, by using gain and delay adjustments and/or low-order digital filters applied to the loudspeaker channels, and performing a search algorithm for obtaining the parameters for said gains, delays and filters.

According to a fourth aspect, there is provided a system configured for controlling bass reproduction properties of an associated multichannel audio system.

The audio system has inputs for at least two audio input signals and comprises a set of loudspeakers, including at least one bass-capable loudspeaker and at least two high-range loudspeakers, each loudspeaker being associated with a loudspeaker channel.

The system configured for controlling bass reproduction properties is configured to obtain impulse responses or transfer functions that represent the sound reproduction properties of each loudspeaker channel at a number of measurement or control positions.

The system configured for controlling bass reproduction properties is also configured to tune, when the audio system includes more than one bass-capable loudspeaker, loudspeaker channels of at least two bass loudspeakers to each other so that their sum impulse response has minimum spatial variability, and/or control high-range loudspeaker speaker channels to be in-phase with each other and/or with bass-capable loudspeaker channel(s) in a crossover frequency band.

In a particular example, the system configured for controlling bass reproduction properties comprises at least one processor and memory, the memory comprising instructions, which when executed by the at least one processor, cause the at least one processor to obtain information representative of said impulse responses or transfer functions, and tune loudspeaker channels of at least two bass loudspeakers to each other and/or control high-range loudspeaker speaker channels to be in-phase with each other and/or with bass-capable loudspeaker channel(s) in a crossover frequency band.

According to a fifth aspect, there is provided an audio processing system comprising a system configured for controlling bass reproduction properties of an associated multichannel audio system as described herein.

According to a sixth aspect, there is also provided an audio system comprising such an audio processing system.

For a better understanding, the proposed technology will now be described with reference to non-limiting, illustrative examples.

By way of example, the fine-tuning of the loudspeaker channels may be performed in one or more of three main design steps that strive to solve interrelated problems:

Step 1: Reducing the spatial variability of the frequency response in the bass region, in cases where the system contains more than one bass-capable loudspeaker, Step 2: Reducing out-of-phase behavior between the channels of left/right high-range loudspeaker pairs, in a frequency band around the crossover frequency, and/or Step 3: Reducing out-of-phase behavior between the bass speakers and the high-range channels, in a frequency band around the crossover frequency.

For example, some functional key features for solving one or more of these interrelated problems can be summarized as:

Step 1: Determine/optimize the parameters for gain factors, delays and all-pass filters operating on signals connected to the bass-capable speakers (e.g. steps B1-B7 below), using a criterion function that measures and/or represents spatial variability in the bass region, and a parameter search over a search space of admissible gain, delay and filter parameters.

Step 2: Determine/optimize the parameters for all-pass filters operating on signals connected to the high-range left/right speaker pairs (e.g. steps C1-C6 below), using a criterion function that measures and/or represents the magnitude of the sum of the transfer functions of the left/right speakers around the crossover frequency, and a parameter search over a search space of admissible filter parameters.

Step 3: Determine/optimize the parameters for all-pass filters operating on signals connected to the high-range speakers and to the bass-capable speakers (e.g. steps D1-D10 or E1-E8 below), using a criterion function that measures and/or represents the magnitude of the sum of the transfer functions of the high-range speakers and of a bass channel for (going to and/or formed by) the bass-capable speaker(s), and a parameter search over a search space of admissible filter parameters.

Figure 2:
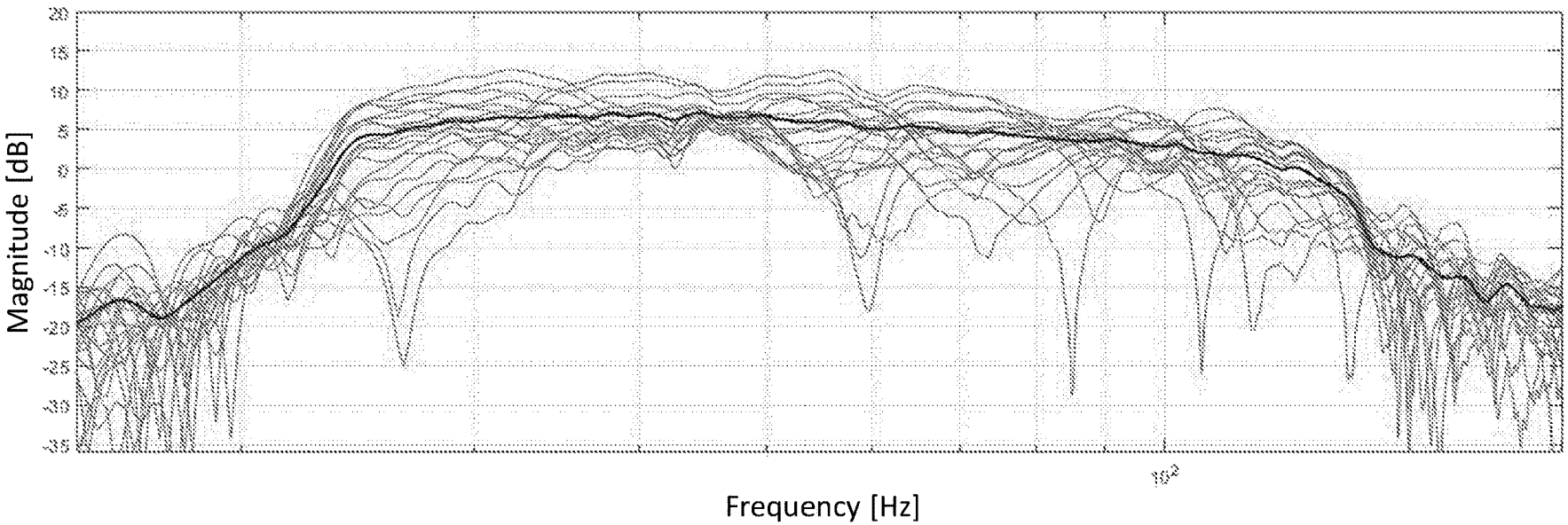
FIG. 2 shows the frequency responses of a subwoofer, measured at 21 positions in a room (grey lines), and their RMS average (black line).
Figure 3:
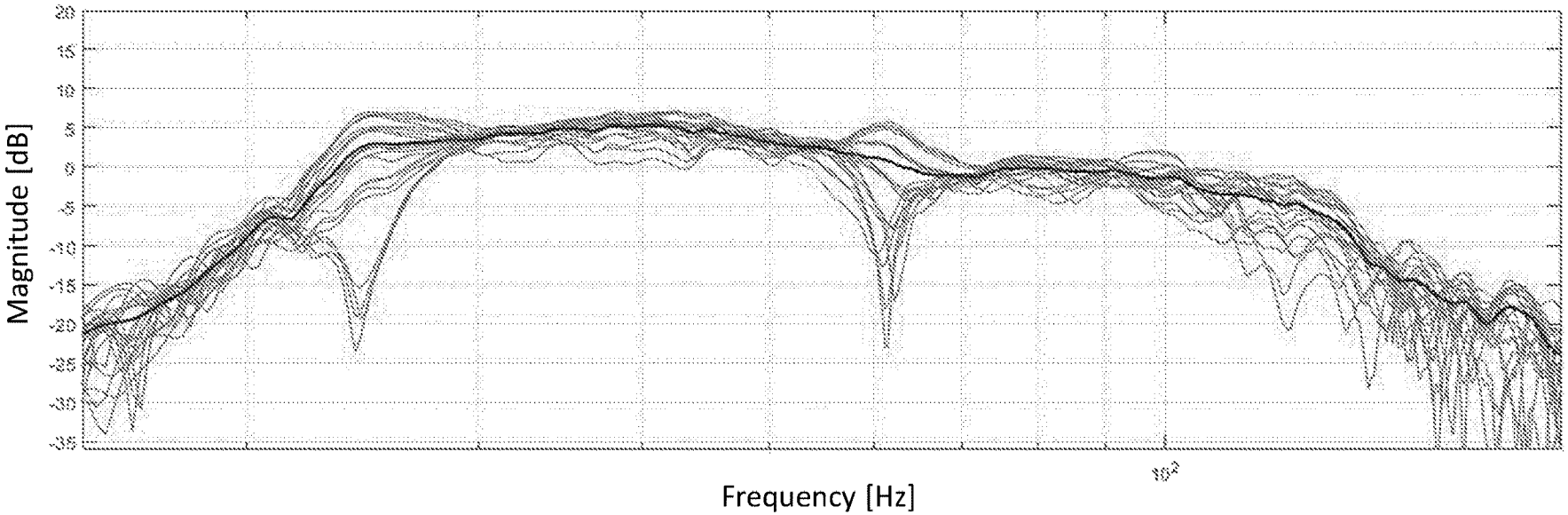
FIG. 3 shows the frequency responses of the acoustic sum of three subwoofers, measured at 21 positions in a room (grey lines), and their RMS average (black line).
Figure 4:
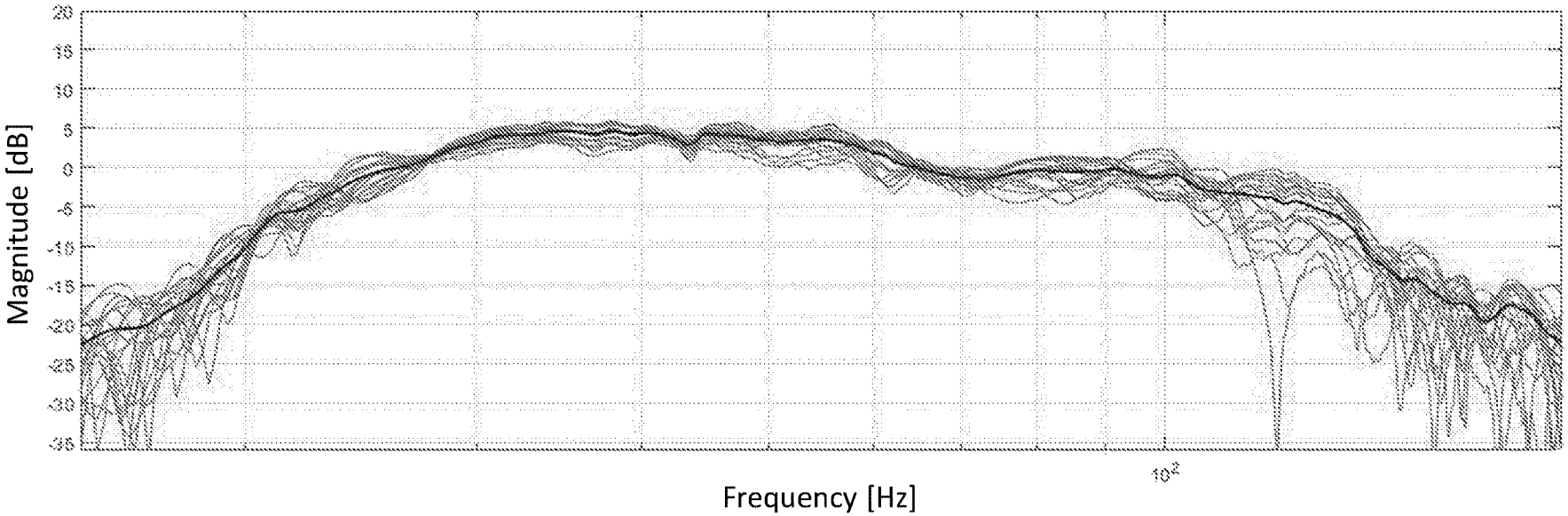
FIG. 4 shows the frequency responses of the acoustic sum of the same three subwoofers as in FIG. 2, after applying a small level adjustment and two second order all-pass filters to each subwoofer. The all-pass filters and level adjustments were tuned according to the method of the present invention, with a criterion that reduces the spatial variation of the frequency response between 30 Hz and 100 Hz.

The benefit of step 1 above can be illustrated by the following example:

FIG. 2 shows frequency responses of a subwoofer measured at 21 positions in a room. It is clear from the figure that although the average frequency response (thin black line) is smooth and well behaved, the response at each measurement or control position is very irregular, and the variations in level across positions are on the order of 20-30 dB at some frequencies. The use of multiple subwoofers can help to mitigate such irregularities, especially if their locations, relative levels and phase relationships are chosen carefully so that they interact with the room and with each other in an optimal way. FIG. 3 shows the result of adding two subwoofers to the situation of FIG. 2, so that three subwoofers are connected to the same input signal. Clearly, the spatial variations are reduced for most frequencies, but some variability remains around 25 Hz and 60 Hz. Merely adding more subwoofers to the system thus seems helpful in reducing variations, but as the remaining variations indicate, the end result may not be fully predictable. In order to get the most out of the multiple subwoofer scenario, the present invention provides a fine-tuning of the levels, delays and phase responses of individual subwoofers, under a criterion that the variations across space are minimized in a selected band of frequencies. FIG. 4 shows the result of such a fine-tuning, where a gain factor, a delay and a cascade of second-order all-pass filters have been applied to the signal path of each subwoofer.

Figure 5:
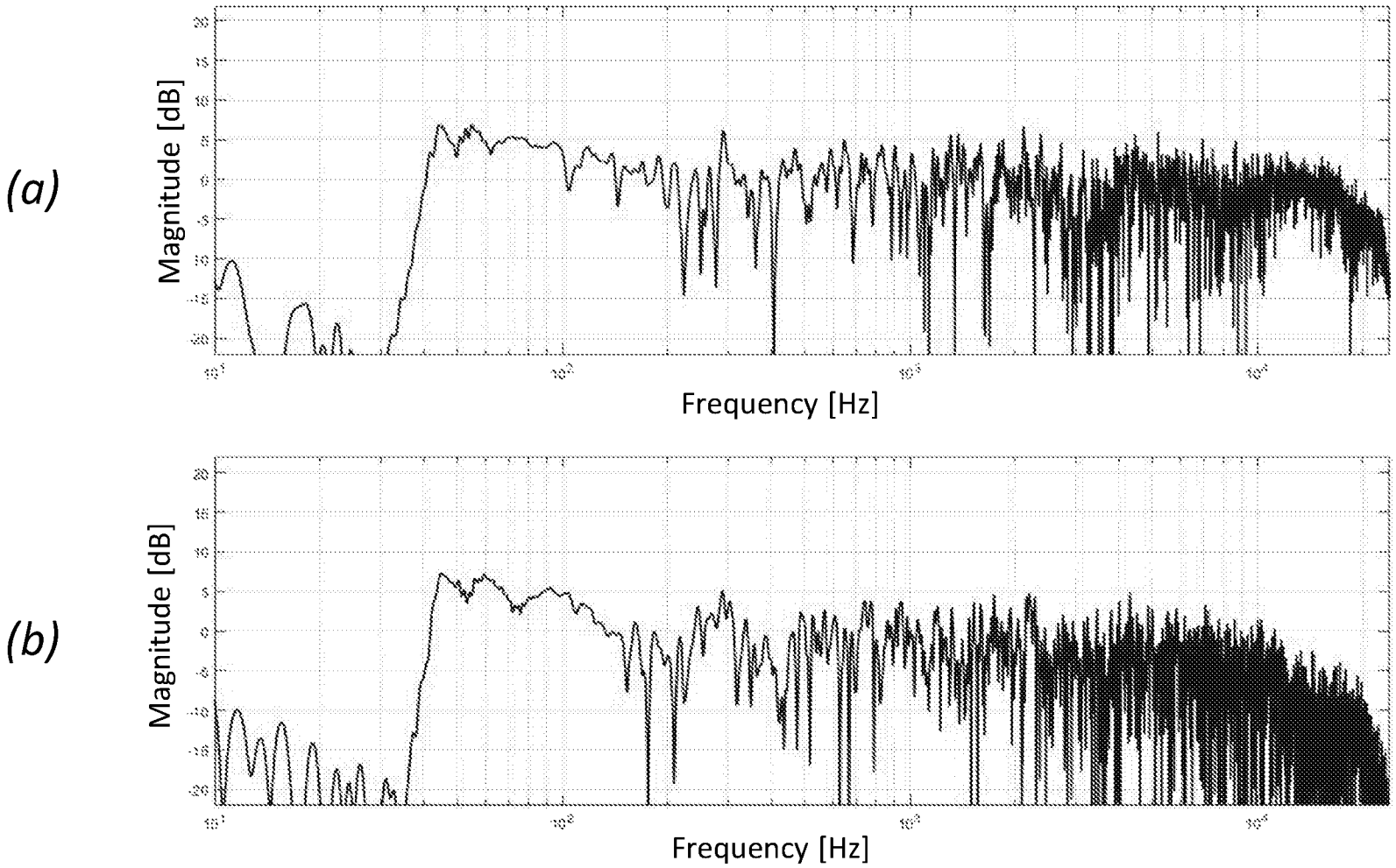
FIG. 5 shows the frequency responses of a stereo pair of loudspeakers, as measured with a microphone in one position in a room.
Figure 6:
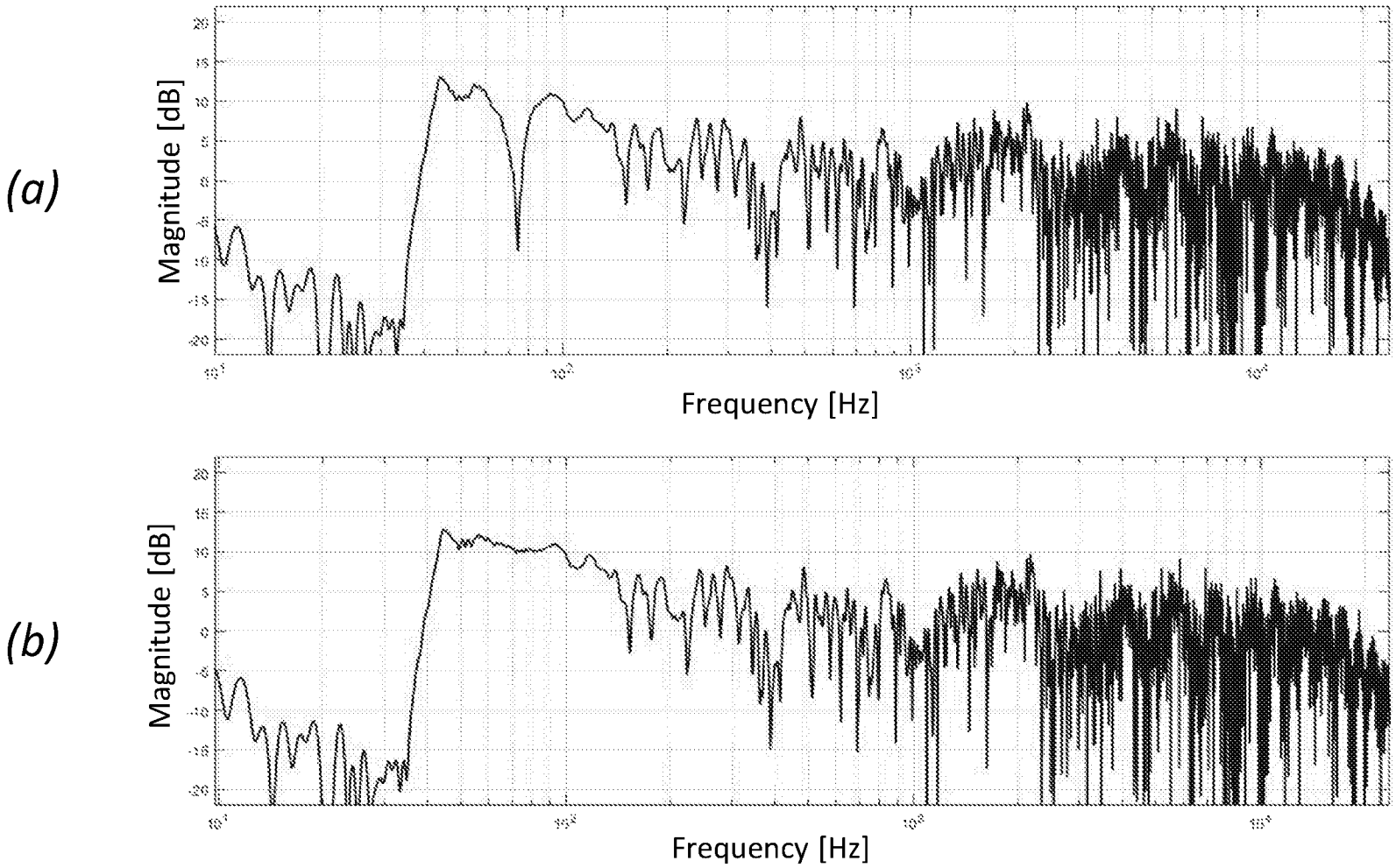
FIG. 6 shows the frequency responses of the acoustic sum of the responses in FIG. 5 (*a*) and FIG. 5 (*b*).

The benefit of step 2 above can be illustrated by the following example:

FIG. 5 shows the frequency responses of a left/right pair of broadband loudspeakers, measured at one position in a room. The FIGS. 5 (*a*) and (*b*) represent the left and right responses, respectively. FIG. 6 (*a*) shows the acoustic sum of these left and right responses. FIG. 6 (*a*) is the response obtained at the measurement or control position when connecting a mono signal source with equal strength to both left and right channels. Clearly, there is a sharp null at about 75 Hz in the frequency response of FIG. 6 (*a*), which cannot be explained by equally sharp nulls in the responses of FIGS. 5 (*a*) and (*b*). The occurrence of this sharp null must therefore be a result of destructive acoustic interference between the left and right channels at 75 Hz. Such destructive interference, or phase cancellation, at bass frequencies is commonly encountered in sound systems that are placed in asymmetric environments, and it will have a negative impact on the bass performance. However, exploiting the aspect of the present invention mentioned as step 2 above, such left/right cancellations can be efficiently mitigated: FIG. 6 (*b*) shows the acoustic sum of the left and right channels of FIGS. 5 (*a*) and (*b*), after the channels have been processed by phase shifting all-pass filters designed according to the method of the present invention.

Figure 7:
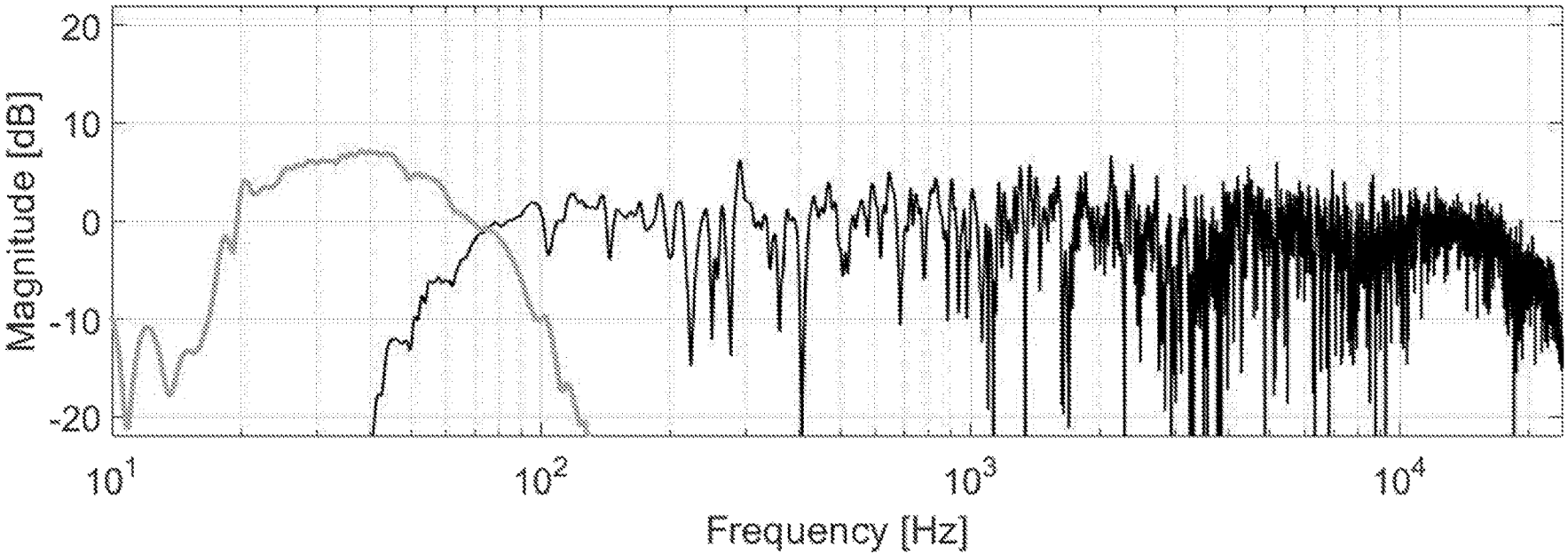
FIG. 7 shows the frequency response of a bass channel and a high-range main channel, where complementary low-pass and high-pass crossover filters have been applied to the bass and high-range channels, respectively. The cutoff frequency of the low/high-pass crossovers in this example was set to 75 Hz.
Figure 8:
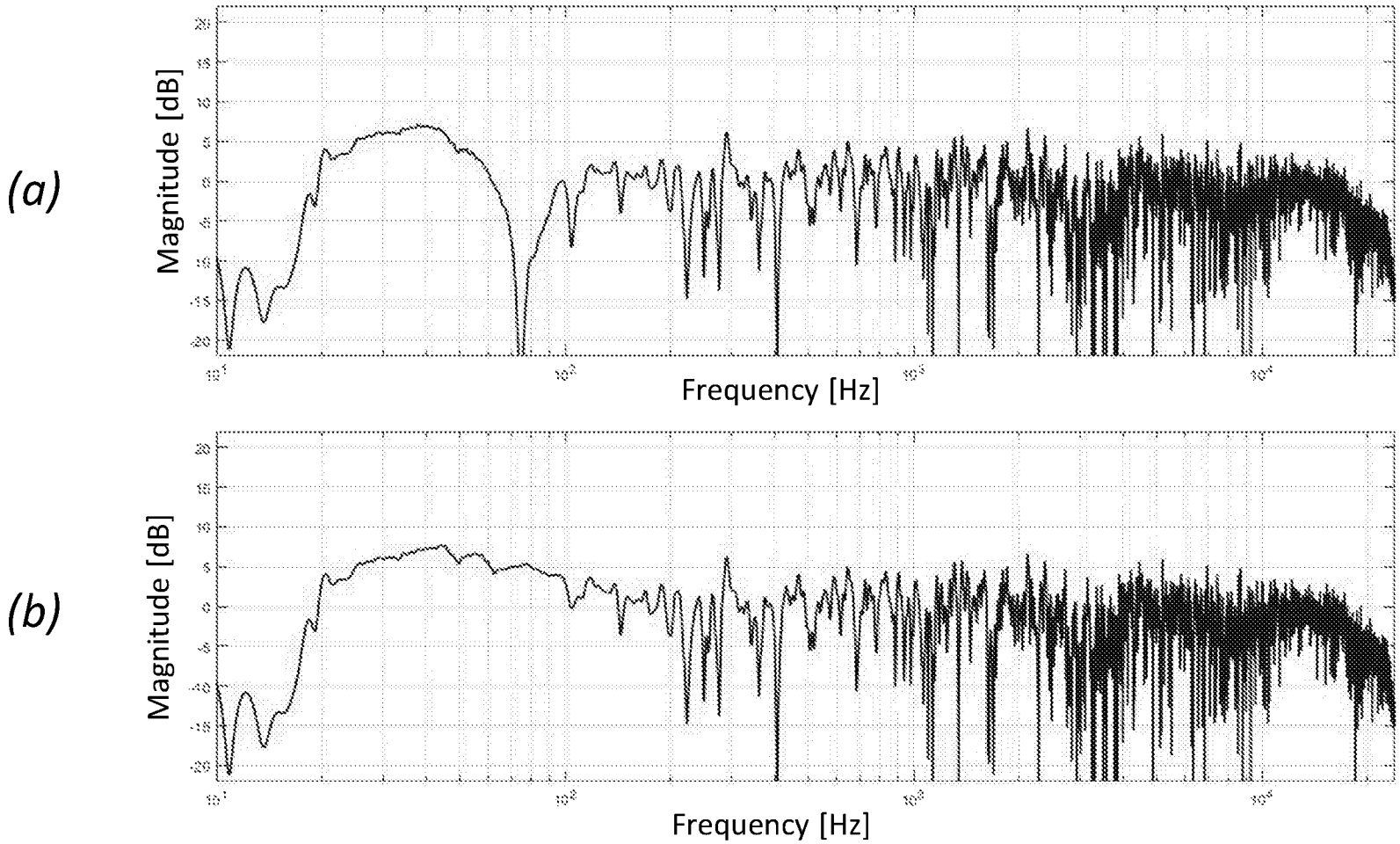
FIG. 8 shows two versions of the acoustic sum of the bass and high-range responses of FIG. 7.

Finally, the benefit of step 3 above can be illustrated by the following example:

Suppose that a sound system containing a left/right main stereo pair of loudspeakers and three subwoofers has been calibrated according to step 1 and step 2 above, so that the three subwoofers are connected together to form a bass channel whose transfer function has a small spatial variation, and the left/right pair of speakers are in-phase with each other in the bass region. After applying low-pass and high-pass crossover filters to the bass channel and the main left/right channels, respectively, the frequency responses at one measurement or control position can look like in FIG. 7, where the grey line is the response of the bass channel and the black line is the response of the left high-range main channel. The cutoff frequency of the low/high-pass crossovers in this example was set to 75 Hz. Now, in order for the bass and main channels of FIG. 7 to form a desired full-band left channel, the frequency response or their sum in the measurement or control position should exhibit a smooth transition over the crossover frequency band around 75 Hz. FIG. 8 (*a*) shows the acoustic sum of the responses of FIG. 7. The deep null at 75 Hz indicates that the bass and main channels are out-of-phase with each other around this frequency. However, if we apply the aspect of the present invention mentioned as step 3 above, we obtain the sum response displayed in FIG. 8 (*b*), where the sharp null is removed and the transition from the bass to the main channel is smooth as desired.

Figure 9:
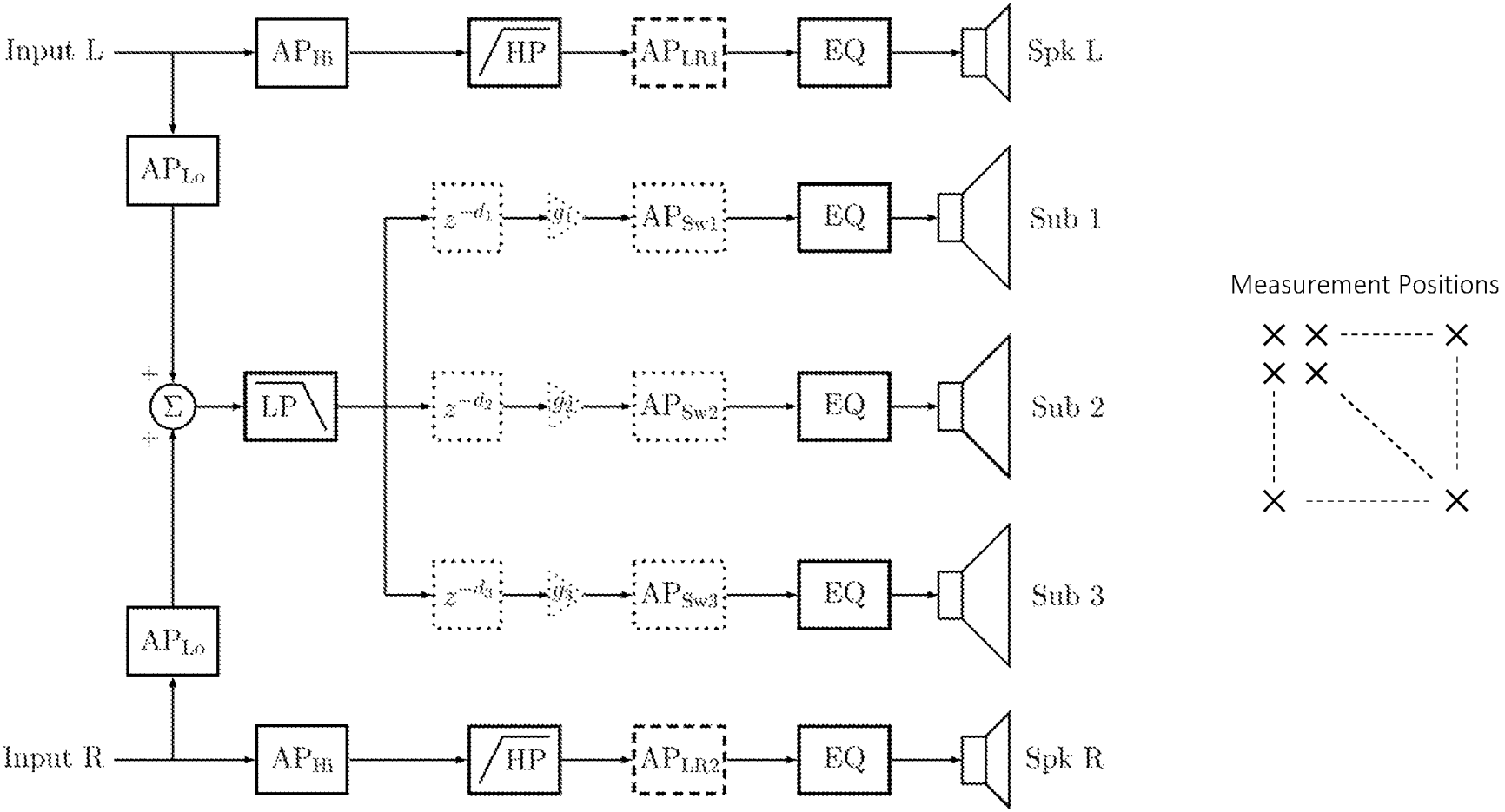
FIG. 9 shows a block diagram example of a stereo system containing a left/right main speaker pair and three subwoofers, connected to a conventional left/right stereo input signal via a network of filters whose parameters can be adjusted according to the method of the present invention. The dotted blocks are designed to minimize spatial variations in the bass by adjusting the subwoofers with regard to phase, delays and gains. The dashed all-pass filter blocks are designed to maximize the phase alignment between the left and right speakers in a selected frequency range at a selected subset of measurement or control positions. In the final step the grey all-pass filter blocks are designed to maximize the phase alignment of the subwoofers and the high-range left/right channels around the crossover frequency, at a selected subset of measurement or control positions.

The sound system referred to in the three examples above can be conceptually described on block diagram form as in FIG. 9: The three subwoofers are named Sub 1, Sub 2, Sub 3, and the main left and right loudspeakers are named Spk L and Spk R, respectively. The processing blocks corresponding to design step 1 described above are indicated with dotted lines in the block diagram, and consist of a delay block, a gain factor and an all-pass filter of selectable order. The processing blocks corresponding to step 2 are indicated with dashed lines, each consisting of an all-pass filter of selectable order, and the processing blocks corresponding to step 3 are indicated with light grey lines and consist of all-pass filters of selectable order. The blocks named LP and HP are the crossover filters, and the blocks named EQ contain optional, loudspeaker-specific processing such as e.g., equalization filters. On the rightmost side of FIG. 9 is a grid of points representing measurement or control positions, where transfer function data for each loudspeaker is acquired.

It should be noted that steps 2-3 above may have to be executed several times, if the sound system in question contains several left/right pairs of loudspeakers or combinations of single speakers and left/right pairs (e.g., 5.1 surround systems that contain both a front left/right and a surround left/right pair as well as a single center speaker). Typically, step 1 would be executed once, to fine-tune the bass speakers to each other so that their sum response has minimum spatial variability. Then, step 2 and 3 would be executed once for each stereo pair of speakers, and step 3 would be executed once for each single speaker (such as e.g. the center speaker in a 5.1 surround system).

It should also be noted that step 1 cannot be performed if the sound system contains only one bass speaker, because spatial variations in the bass are controlled by tuning the delay, gain and phase, relationships between at least two independent bass speakers.

Figure 10:
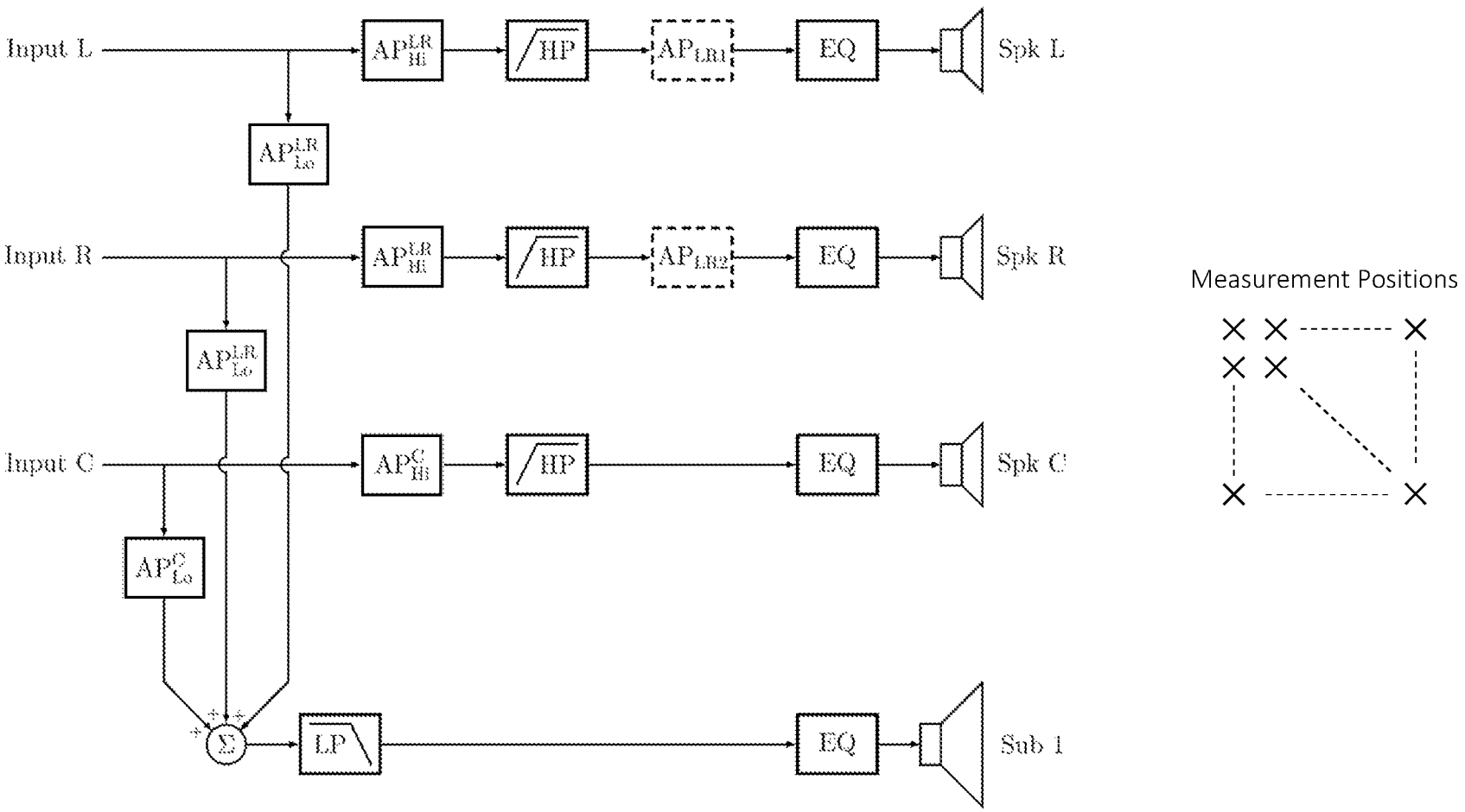
FIG. 10 shows another block diagram example of a three-channel system containing a left/right main speaker pair, a center speaker and one subwoofer, connected to three input signals via a network of filters whose parameters can be adjusted according to the method of the present invention.

FIG. 10 shows an example of a system with one subwoofer, one stereo left/right speaker pair and one single center channel. If one associates the various processing blocks of FIG. 10 with the design steps 1-3, as in the above description of FIG. 9, then it is clear that step 1 has no corresponding block for this single subwoofer. Step 2 (blocks with dashed lines) is executed once for the Spk L/Spk R pair but not for Spk C, and step 3 is executed twice—once for the Spk L/Spk R pair and once for Spk C.

Figure 11:
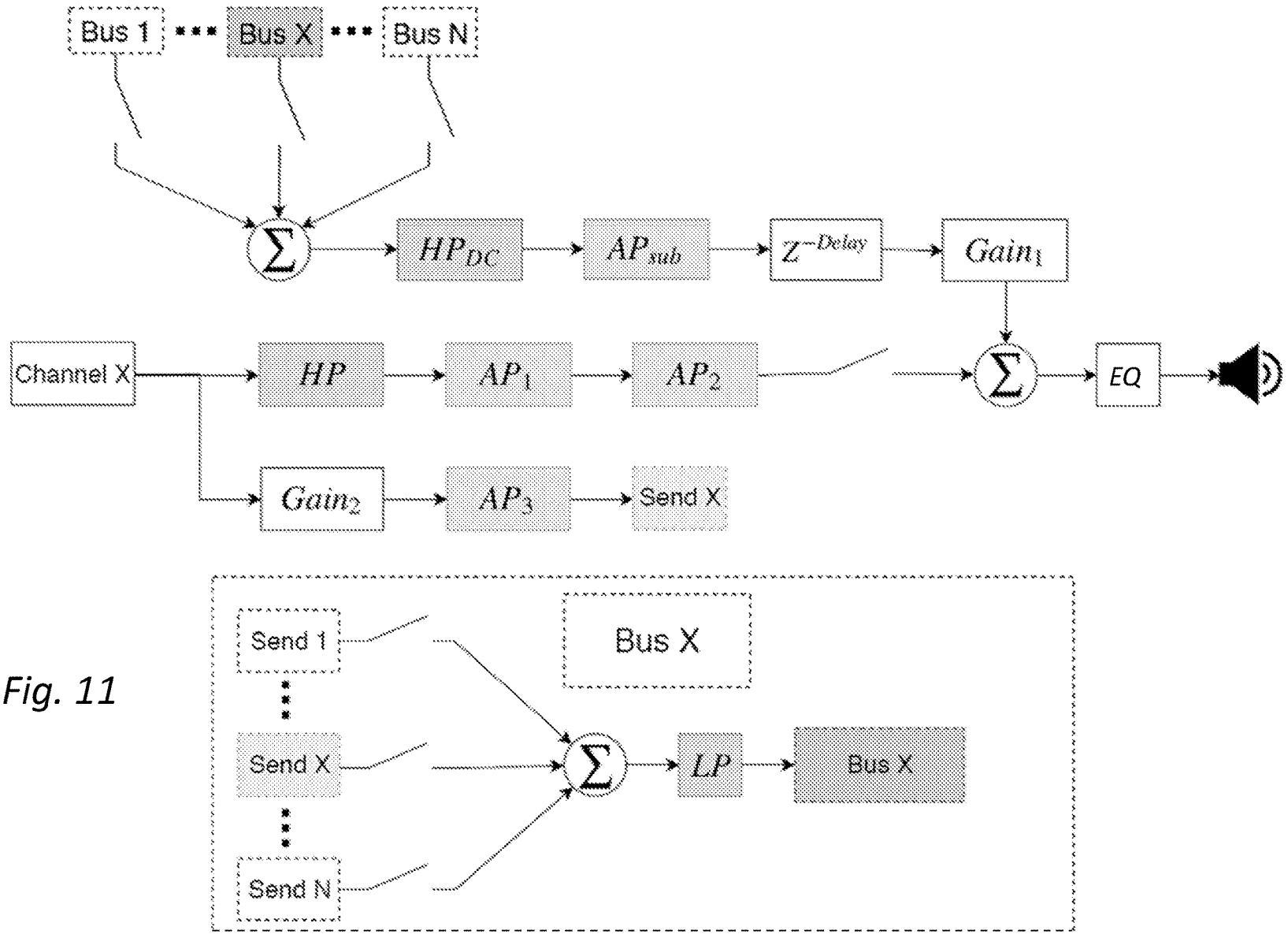
FIG. 11 shows a block diagram for one generic audio channel that can send and receive signals to/from other channels via a bus structure.

For example, from a product perspective it may be important that the filter network for the presented bass management solution can be implemented in all its various configurations using a common generic runtime processing structure and codebase. In the following we describe a DSP filtering structure intended to fulfill the necessary configurability requirements. The filtering structure is shown in FIG. 11 in the form of a block diagram for one generic audio channel that can send and receive signals to/from other channels via a bus structure. By a proper interconnection of several instances of such channels and buses, the desired processing chain for any specific bass management case (such as, for example, the cases illustrated in FIG. 9 and FIG. 10) can be obtained. The generic processing channel has a "main" signal path connecting an input signal to a loudspeaker output, via a series of filter blocks: One high-pass filter (HP) and two all-pass filters ($AP_1$ and $AP_2$), an on/off switch and an optional loudspeaker equalization filter (EQ). In addition to the main path, the generic channel has a "send" branch on the input side, where the input signal can be routed to one or several buses via a gain ($Gain_2$) and an all-pass filter ($AP_3$). Finally, on the output side there is a "receive" branch, where the signals from one or several buses (Bus 1, . . . , Bus N) are summed and processed with a high-pass filter ($HP_{DC}$), an all-pass filter ($AP_{Sub}$), a delay ($Z^{-Delay}$) and a gain factor ($Gain_1$), and then added to the signal that goes to the loudspeaker. The bus itself contains a summation of all send branches (Send 1, . . . , Send N), and a low-pass filter (LP). The concept of sending and receiving signals between channels via an intermediate bus structure makes it possible to branch off the low-frequency content of all input signals (using the "send" branch) and route it to the selected bass-capable loudspeakers (using the "receive" branch). The number of buses needed depends on the number of different crossover frequencies used by the system. If the same crossover frequency is used for all input channels, then only one bus is needed. For example, in a 5.1 system where the user chooses to use different crossovers for front (70 Hz), center (80 Hz) and surround (90 Hz), three buses will be needed.

Further Non-Limiting Examples

By way of example, given a sound system comprising L≥2 loudspeakers, where at least one loudspeaker is capable of reproducing frequencies below 200 Hz (henceforth referred to as "bass speaker(s)") and at least one loudspeaker is capable of reproducing frequencies above 200 Hz (henceforth referred to as "high-range speakers"), the overall method for realizing one or more of the design steps 1-3 described above can be exemplified as follows (steps A1-A3 below apply generally; steps B1-B7 apply if the system has more than one bass speaker; steps C1-C6 and D1-D10 apply for left/right pairs of high-range speakers, and steps E1-E8 apply for single high-range speakers that are not part of a left/right pair):

A1. Acquire (measure and/or receive relevant data) a set of M×L impulse responses or transfer functions $H_{11}$, . . . , $H_{ML}$, representing sound propagation from L≥2 loudspeaker channels to M≥2 measurement or control positions. The impulse responses or transfer functions may be acquired through measurements using a test signal and a microphone, or through simulations based on a computational model of the loudspeakers and the room.

A2. Determine the crossover frequency for all high-range speakers. If the system contains more than one high-range speaker and the high-range speakers are of different type, it may be needed to determine several different crossover frequencies.

A3. For each determined crossover frequency, determine a pair of complementary low-pass/high-pass crossover filters, LP and HP. The crossover filters LP and HP can be for example Linkwitz-Riley IIR filters or linear phase FIR filters, whose cutoff frequencies are equal to the determined crossover frequency.

B1. Determine a set of nf frequencies $F_{eval}=\{f_0, f_1, \ldots, f_{nf-1}\}$ covering the frequency band in the bass where a reduced spatial variability of the frequency response is desired. The frequencies in $F_{eval}$ may be used for evaluation of filters and loudspeaker transfer functions, and for evaluation of criterion functions related to said filters and transfer functions.

B2. Determine a desired number of second order all-pass filter sections per bass speaker, to be used in the fine-tuning of the relative phases between the bass speakers, and determine a minimum and maximum allowed value of the Q factor for said second order all-pass filters, and a minimum and maximum allowed value of the center frequency for said second order all-pass filters.

B3. Determine a maximum allowed value of the delay for the bass speakers, to be used in the fine-tuning of the relative delays between the bass speakers.

B4. Determine a minimum and maximum allowed value of the gain factor for the bass speakers, to be used in the fine-tuning of the relative gain factors between the bass speakers.

B5. In the parameter space defined by the total number of all-pass filters and by the allowed ranges of values of said Q factors, center frequencies, delays and gain factors, find parameter values that produce a reduced spatial variability of the frequency response of the sum of the bass speaker transfer functions, as measured by a variability criterion function, when said all-pass filters, delays and gain factors are applied to the bass speaker signals. Said variability criterion function can, for example, be a weighted sum of several terms, each term measuring a specific aspect of the spatial variability of processed versions of the acquired transfer functions, for frequencies in $F_{eval}$. The search method for finding said parameter values can, for example, be a genetic search algorithm, in which case all filter parameters, delays and gains that constitute a full configuration of the processing blocks for the bass speakers (such as for example the dotted blocks of FIG. 9) are encoded into the format of a binary string.

B6. Use the parameters found in step B5 to configure an all-pass filter, a gain factor and a delay in the signal path of each bass speaker (as an example, consider the signal paths of Sub 1, Sub 2 and Sub 3 in FIG. 9).

B7. Connect the signal paths of the bass speakers to a single input so that the bass speakers form a single bass channel characterized by a reduced spatial variability.

C1. Out of the L loudspeakers, select two speakers that form a left/right high-range pair, having crossover frequency $f_c$ and associated crossover filters LP and HP as determined in steps A2 and A3.

C2. Determine a set of ng frequencies $G_{eval}=\{g_0, g_1, \ldots, g_{ng-1}\}$ covering a frequency band around the crossover frequency.

C3. Determine a desired number of second order all-pass filter sections per speaker in said high-range speaker pair, to be used in the fine-tuning of the relative phases between the speakers in the pair, and determine a minimum and maximum allowed value of the Q factor for said second order all-pass filters, and a minimum and maximum allowed value of the center frequency for said second order all-pass filters.

C4. In the parameter space defined by the total number of all-pass filters and by the allowed ranges of values of said Q factors and center frequencies determined in step C3, find parameter values that increase the magnitude of the transfer function of the acoustic sum of the speakers in the pair, as measured by a magnitude maximization criterion function, when said all-pass filters are applied to the speakers in the high-range pair. Said magnitude maximization criterion function can, for example, be a weighted sum of several terms, each term measuring a specific aspect of the magnitude of the sum of processed versions of the acquired transfer functions, over a subset of measurement or control positions, for frequencies in $G_{eval}$. The search method for finding said parameter values can, for example, be a genetic search algorithm, in which case all filter parameters that constitute a full configuration of the processing blocks for the high-range speaker pair (such as for example the dashed blocks of FIG. 9) are encoded into the format of a binary string.

C5. Use the parameters found in step C4 to configure an all-pass filter block in the signal path of each high-range speaker in the selected speaker pair (as an example, consider the signal paths of Spk L and Spk R in FIG. 9).

C6. If the loudspeakers of the sound system in question are grouped into several left/right high-range speaker pairs, then steps C1-C6 should be repeated for each such high-range speaker pair.

D1. Out of the L loudspeakers, select two speakers that form a left/right high-range pair, having crossover frequency $f_c$ and associated crossover filters LP and HP as determined in steps A2 and A3.

D2. If steps B1-B7 have been performed for the bass speakers, then apply the delays, gain factors and all-pass filters found in step B5 to the acquired transfer functions of the bass speakers, and compute their sum response in all measurement or control positions, yielding the desired bass channel response, i.e., the transfer functions for the bass channel obtained in step B7. If the system contains only one bass speaker, then the bass channel response will consist of the acquired transfer functions for the single bass speaker.

D3. If steps C1-C5 have been performed for the selected speaker pair, then apply the all-pass filters found in step C4 to the acquired transfer functions of the respective speakers in the selected pair.

D4. Apply the crossover filters LP and HP associated with the selected high-range speaker pair to the transfer functions of the bass channel and to the transfer functions of the selected high-range speaker pair, respectively.

D5. Compute the sum of the transfer functions of the selected high-range speaker pair, yielding a high-range speaker sum response, in a selected subset of measurement or control positions.

D6. Determine a set of nj frequencies $J_{eval}=\{j_0, j_1, \ldots, j_{nj-1}\}$ covering a frequency band around the crossover frequency associated with the selected high-range speaker pair.

D7. Determine a desired number of second order all-pass filter sections for the bass channel, and a desired number of second order all-pass filter sections per speaker in said high-range speaker pair, to be used in the fine-tuning of the relative phases between the high-range speaker sum responses and the bass channel response, and determine a minimum and maximum allowed value of the Q factor for said second order all-pass filters, and a minimum and maximum allowed value of the center frequency for said second order all-pass filters.

D8. In the parameter space defined by the total number of all-pass filters and by the allowed ranges of values of said Q factors and center frequencies determined in step D7, find parameter values that increase the magnitude of the transfer function of the acoustic sum of the high-range speaker sum response and the bass channel response, as measured by a magnitude maximization criterion function, when said all-pass filters are applied to the bass channel and to the speakers in the high-range pair. Said magnitude maximization criterion function can, for example, be a weighted sum of several terms, each term measuring a specific aspect of the magnitude of the sum of processed versions of the acquired transfer functions, over a subset of measurement or control positions, for frequencies in $J_{eval}$. The search method for finding said parameter values can, for example, be a genetic search algorithm, in which case all filter parameters that constitute a full configuration of the processing blocks for the bass channel and high-range speaker pair combination (such as for example the grey blocks $AP_{Hi}$ and $AP_{Lo}$ of FIG. 9) are encoded into the format of a binary string.

D9. Use the parameters found in step D8 to configure all-pass filter blocks in the signal path of each high-range speaker in the selected speaker pair and in the signal path associated with the input to the bass channel (as an example, consider the grey blocks $AP_{Hi}$ and $AP_{Lo}$ of FIG. 9).

D10. If the loudspeakers of the sound system in question are grouped into several left/right high-range speaker pairs, then steps D1-D9 should be repeated for each such high-range speaker pair.

E1. Out of the L loudspeakers, select one high-range speaker, having crossover frequency $f_c$ and associated crossover filters LP and HP as determined in steps A2 and A3.

E2. If steps B1-B7 have been performed for the bass speakers, then apply the delays, gain factors and all-pass filters found in step B5 to the acquired transfer functions of the bass speakers, and compute their sum response in all measurement or control positions, yielding the desired bass channel response, i.e., the transfer functions for the bass channel obtained in step B7. If the system contains only one bass speaker, then the bass channel response will consist of the acquired transfer functions for the single bass speaker.

E3. Apply the crossover filters LP and HP associated with the selected high-range speaker to the transfer functions of the bass channel and to the transfer functions of the selected high-range speaker, respectively.

E4. Determine a set of nj frequencies $J_{eval}=\{j_0, j_1, \ldots, j_{nj-1}\}$ covering a frequency band around the crossover frequency associated with the selected high-range speaker.

E5. Determine a desired number of second order all-pass filter sections for the bass channel, and a desired number of second order all-pass filter sections for said high-range speaker, to be used in the fine-tuning of the relative phases between the high-range speaker response and the bass channel response, and determine a minimum and maximum allowed value of the Q factor for said second order all-pass filters, and a minimum and maximum allowed value of the center frequency for said second order all-pass filters.

E6. In the parameter space defined by the total number of all-pass filters and by the allowed ranges of values of said Q factors and center frequencies determined in step E5, find parameter values that increase the magnitude of the transfer function of the acoustic sum of the high-range speaker response and the bass channel response, as measured by a magnitude maximization criterion function, when said all-pass filters are applied to the bass channel and to the high-range speaker. Said magnitude maximization criterion function can, for example, be a weighted sum of several terms, each term measuring a specific aspect of the magnitude of the sum of processed versions of the acquired transfer functions, over a subset of measurement or control positions, for frequencies in $J_{eval}$. The search method for finding said parameter values can, for example, be a genetic search algorithm, in which case all filter parameters that constitute a full configuration of the processing blocks for the bass channel and high-range speaker combination (such as for example the grey blocks $AP^C_{Hi}$ and $AP^C_{Lo}$ of FIG. 10) are encoded into the format of a binary string.

E7. Use the parameters found in step E6 to configure all-pass filter blocks in the signal path of the selected high-range speaker and in the signal path associated with the input to the bass channel (as an example, consider the grey blocks $AP^C_{Hi}$ and $AP^C_{Lo}$ of FIG. 10).

E8. If the loudspeakers of the sound system in question contain several high-range speakers that are not part of a left/right speaker pair, then steps E1-E7 should be repeated for each such high-range speaker.

It should be understood that some of the steps described above may be optional, and that selected steps may occasionally be performed in a different order.

In the filter design and system configuration method described above, two types of criterion functions are mentioned: One criterion function measures and/or represents the spatial variability of a sum of transfer functions in a number of measurement or control positions, and another criterion function measures and/or represents the magnitude of an acoustic sum of transfer functions.

An example of the first type of criterion function can be described as follows:

Let $X_1(f_i)$, $i=0, \ldots, nf-1$, be a function defined on the set of frequencies $F_{eval}$ defined in step B1, where $X_1$ at frequency $f_i$ is computed as the minimum transfer function magnitude at $f_i$ (minimum taken among the measurement points), divided by the maximum transfer function magnitude at $f_i$, (maximum taken among the measurement points). $X_1$ thus defined is a function taking values between 0 and 1, where values close to 0 imply a large spatial variability, and values close to 1 imply a small spatial variability.

Further let $X_2$ be a value computed based on a weighted sum of powers of the values of $X_1$, for example, the root-mean-squared value of $X_1(f_i), \ldots, X_1(f_{nf-1})$.

Further, let $X_3$ be the minimum value of $X_1$, where the minimum is taken over all $f_i$ in $F_{eval}$.

A criterion function for measuring the spatial variability of a set of transfer functions can then be formed as a weighted summation of powers of the values $X_2$ and $X_3$.

An example of the second type of criterion function can be described as follows:

Let $Y_1(g_i)$, $i=0, \ldots, ng-1$, be a function defined on the set of frequencies $G_{eval}$ defined in step C2, where $Y_1$ at frequency $g_i$ is computed as the actually attained magnitude of the sum of a number of transfer functions at a selected measurement or control position at frequency $g_i$, divided by a maximum possible magnitude of the sum of the same transfer functions at the same position and frequency. Typically, the actually obtained magnitude of a sum of transfer functions is computed using the magnitude of the complex sum of the transfer functions, whereas the maximum possible magnitude is computed using the sum of the magnitudes of the transfer functions. $Y_1$ thus defined is a function taking values between 0 and 1, where values close to 0 imply a sum response whose magnitude is far from the maximum attainable magnitude, and values close to 1 imply a magnitude close to the maximum attainable magnitude. The maximum possible magnitude is attained when the transfer functions that constitute the individual parts of the sum are equal in phase. The function $Y_1(g_i)$ is thus a measure of whether the transfer functions being summed are in-phase or out-of-phase.

Further let $Y_2$ be a value computed based on a weighted sum of powers of the values of $Y_1$, for example, the root-mean-squared value of $Y_1(g_i), \ldots, Y_1(g_{ng-1})$.

Further, let $Y_3$ be the minimum value of $Y_1$, where the minimum is taken over all $g_i$ in $G_{eval}$.

A criterion function for measuring the magnitude of a sum transfer functions can then be formed as a weighted summation of powers of the values $Y_2$ and $Y_3$.

It will be appreciated that the methods and arrangements described herein can be implemented, combined and rearranged in a variety of ways.

By way of example, there is provided a system or apparatus configured to perform the method as described herein.

For example, embodiments may be implemented in hardware, or in software for execution by suitable processing circuitry, or a combination thereof.

The steps, functions, procedures, modules and/or blocks described herein may be implemented in hardware using any conventional technology, such as discrete circuit or integrated circuit technology, including both general-purpose electronic circuitry and application-specific circuitry.

Alternatively, or as a complement, at least some of the steps, functions, procedures, modules and/or blocks described herein may be implemented in software such as a computer program for execution by suitable processing circuitry such as one or more processors or processing units.

Examples of processing circuitry includes, but is not limited to, one or more microprocessors, one or more Digital Signal Processors (DSPs), one or more Central Processing Units (CPUs), video acceleration hardware, and/or any suitable programmable logic circuitry such as one or more Field Programmable Gate Arrays (FPGAs), or one or more Programmable Logic Controllers (PLCs).

It should also be understood that it may be possible to re-use the general processing capabilities of any conventional device or unit in which the proposed technology is implemented. It may also be possible to re-use existing software, e.g. by reprogramming of the existing software or by adding new software components.

It is also possible to provide a solution based on a combination of hardware and software. The actual hardware-software partitioning can be decided by a system designer based on a number of factors including processing speed, cost of implementation and other requirements.

As should be understood, the design procedure described herein can be seen as a way of designing a network of filters, sometimes simply referred to as a filter network, which may be distributed.

Typically, the design procedure described herein is implemented on a separate computer system to produce the filter parameters of the considered network of filters. The calculated filter parameters are then normally downloaded to the filters, for example realized by a digital signal processing system or similar computer system, which executes the actual filtering. For example, the network of filters may be implemented as a Digital Signal Processor (DSP) structure.

Although the invention can be implemented in software, hardware, firmware or any combination thereof, the design scheme proposed by the invention is preferably implemented as software in the form of program modules, functions or equivalent. The software may be written in any type of computer language, such as C, C++ or even specialized languages for DSPs. In practice, the relevant steps, functions and actions of the invention are mapped into a computer program, which when being executed by the computer system effectuates the calculations associated with the design of the filter network. In the case of a PC-based system, the computer program used for the design of the audio filter network is normally encoded on a computer-readable medium such as a DVD, CD or similar structure for distribution to the user/filter designer, who then may load the program into his/her computer system for subsequent execution. The software may even be downloaded from a remote server via the Internet.

Figure 12:
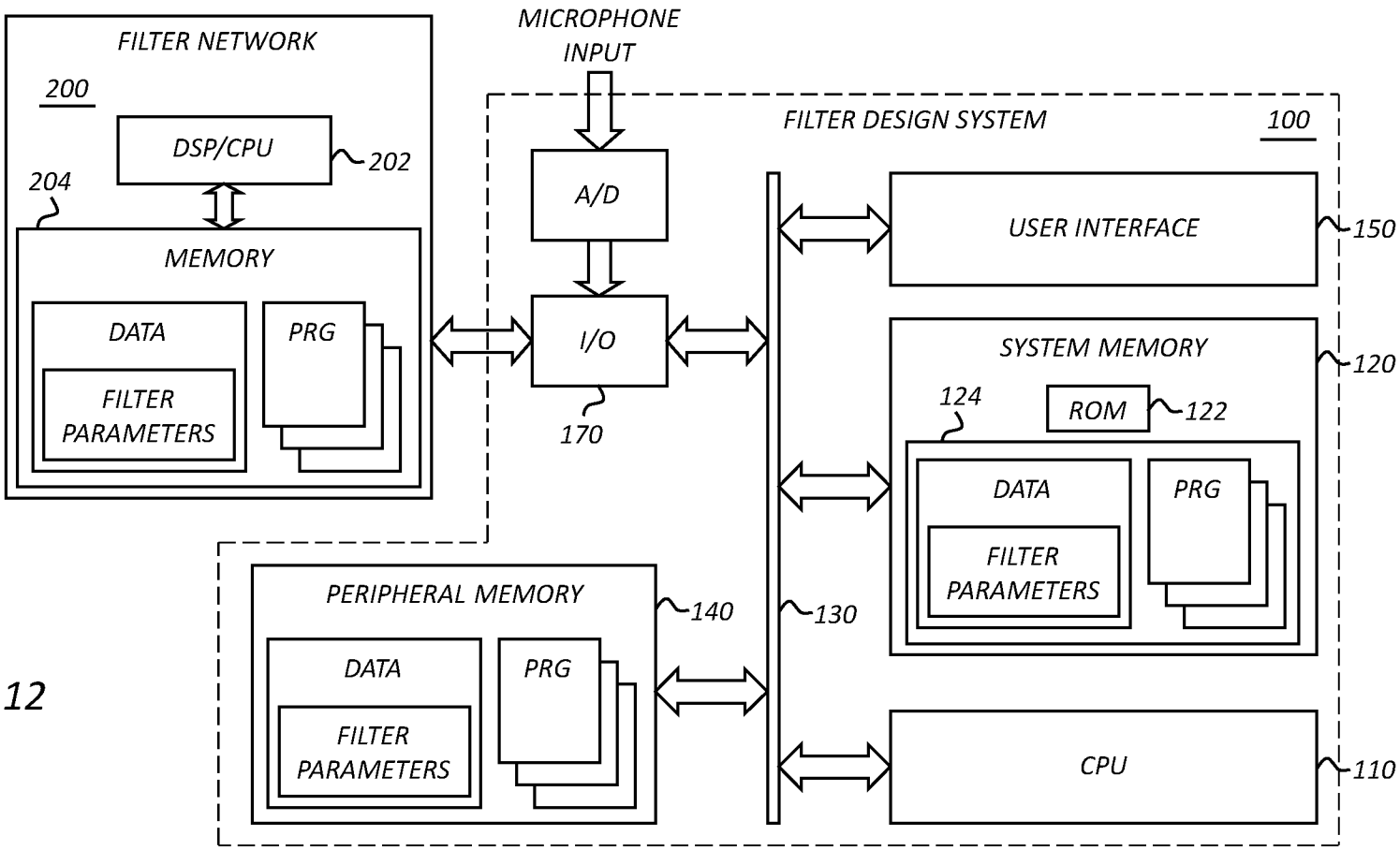
FIG. 12 is a schematic block diagram illustrating an example of a computer system suitable for implementation of a filter design algorithm according to the invention.

FIG. 12 is a schematic block diagram illustrating an example of a computer system suitable for implementation of a filter design algorithm according to the invention. The system 100 may be realized in the form of any conventional computer system, including personal computers (PCs), mainframe computers, multiprocessor systems, network PCs, digital signal processors (DSPs), and the like. Anyway, the system 100 basically comprises a central processing unit (CPU) or digital signal processor (DSP) core 110, a system memory 120 and a system bus 130 that interconnects the various system components. The system memory 120 typically includes a read only memory (ROM) 122 and a random access memory (RAM) 124. Furthermore, the system 100 normally comprises one or more driver-controlled peripheral memory devices 140, such as hard disks, magnetic disks, optical disks, floppy disks, digital video disks or memory cards, providing non-volatile storage of data and program information. Each peripheral memory device 40 is normally associated with a memory drive for controlling the memory device as well as a drive interface (not illustrated) for connecting the memory device 140 to the system bus 130. A filter design program implementing a design algorithm according to the invention, possibly together with other relevant program modules, may be stored in the peripheral memory 140 and loaded into the RAM 122 of the system memory 120 for execution by the CPU 110. Given the relevant input data, such as a model representation and other optional configurations, the filter design program calculates the filter parameters of the filter network.

The determined filter parameters are then normally transferred from the RAM 124 in the system memory 120 via an I/O interface 170 of the system 100 to a filter network system 200. Preferably, the filter network system 200 is based on a digital signal processor (DSP) or similar central processing unit (CPU) 202, and one or more memory modules 204 for holding the filter parameters and the required delayed signal samples. The memory 204 normally also includes a filtering program, which when executed by the processor 202, performs the actual filtering based on the filter parameters.

Instead of transferring the calculated filter parameters directly to a filter network system 200 via the I/O system 170, the filter parameters may be stored on a peripheral memory card or memory disk 140 for later distribution to a filter network system, which may or may not be remotely located from the filter design system 100. The calculated filter parameters may also be downloaded from a remote location, e.g. via the Internet, and then preferably in encrypted form.

In order to enable measurements of sound produced by the audio equipment under consideration, any conventional microphone unit(s) or similar recording equipment may be connected to the computer system 100, typically via an analog-to-digital (A/D) converter. Based on audio measurements made by the microphone unit, the system 100 can provide a suitable filter design, e.g. using an application program loaded into the system memory 120. The measurements may also be used to evaluate the performance of the combined system of filter network and audio equipment. If the designer is not satisfied with the resulting design, he may initiate a new optimization of the filter network based on a modified set of design parameters.

Furthermore, the system 100 typically has a user interface 150 for allowing user-interaction with the filter designer. Several different user-interaction scenarios are possible.

For example, the filter designer may decide that he/she wants to use a specific, customized set of design parameters in the calculation of the filter parameters of the filter system 200. The filter designer then defines the relevant design parameters via the user interface 150.

It is also possible for the filter designer to select between a set of different preconfigured parameters, which may have been designed for different audio systems, listening environments and/or for the purpose of introducing special characteristics into the resulting sound. In such a case, the preconfigured options are normally stored in the peripheral memory 140 and loaded into the system memory during execution of the filter design program. The filter designer may also define a reference system by using the user interface 150.

Preferably, the resulting audio filter is embodied together with the sound generating system so as to enable generation of sound influenced by the filter.

In an alternative implementation, the filter design is performed more or less autonomously with no or only marginal user participation, e.g. based on a supervisory program that interacts with the filter design software to generate a set of filter parameters.

The final set of filter parameters are downloaded/implemented into the filter network system.

It is also possible to adjust the filter parameters of the filter network adaptively, instead of using a fixed set of filter parameters. During the use of the filter in an audio system, the audio conditions may change. For example, the position of the loudspeakers and/or objects such as furniture in the listening environment may change, which in turn may affect the room acoustics, and/or some equipment in the audio system may be exchanged by some other equipment leading to different characteristics of the overall audio system. In such a case, continuous or intermittent measurements of the sound from the audio system in one or several positions in the listening environment may be performed by one or more microphone units or similar sound recording equipment. The recorded sound data may then be fed into a filter design system, such as system 100 of FIG. 12, which adjusts the filter parameters so that they are better adapted for the new audio conditions.

Naturally, the invention is not limited to the arrangement of FIG. 12. As an alternative, the design of the filter network and the actual implementation of the filter may both be performed in one and the same computer system 100 or 200. This generally means that the filter design program and the filtering program are implemented and executed on the same DSP or processor system.

The filter network system may be realized as a stand-alone equipment in a digital signal processor or computer that has an analog or digital interface to the subsequent amplifiers, as mentioned above. Alternatively, it may be integrated into the construction of a digital preamplifier, a computer sound card, a car audio system, a compact stereo system, a home cinema system, a computer game console, a TV, a mobile phone or smartphone or any other device or system aimed at producing sound. It is also possible to realize the filter network in a more hardware-oriented manner, with customized computational hardware structures, such as FPGAs or ASICs.

Figure 13:
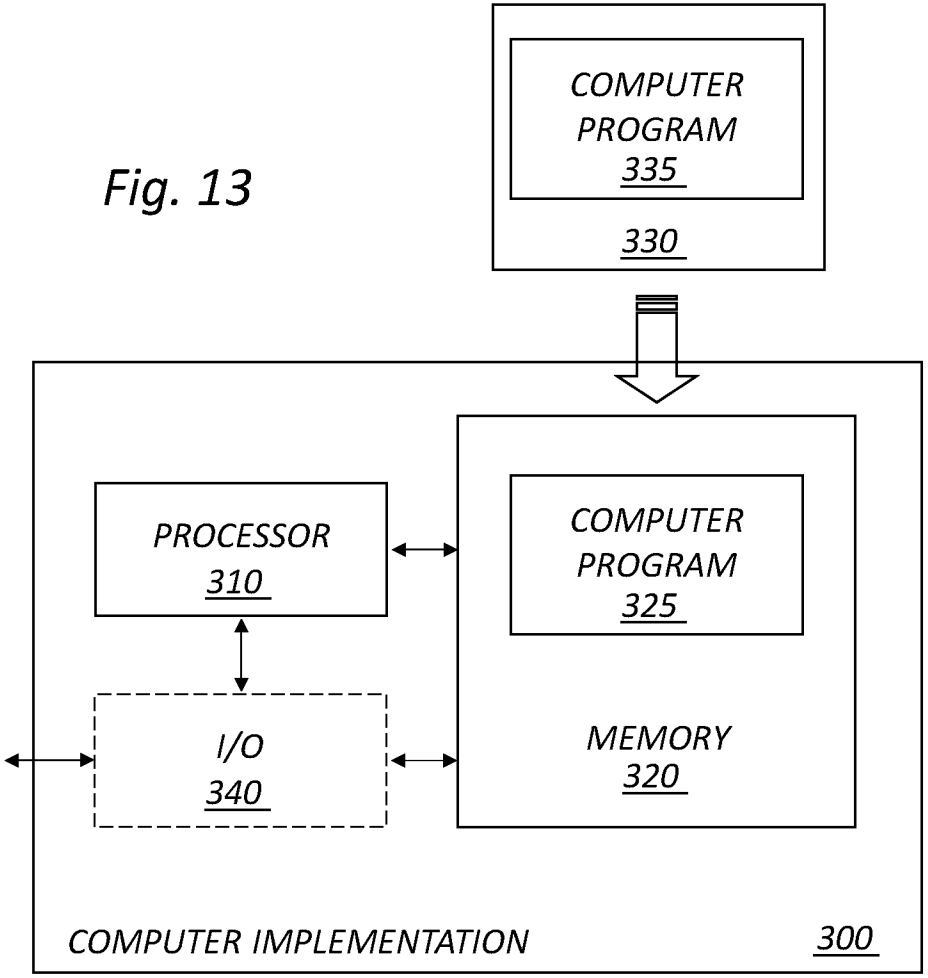
FIG. 13 is a schematic diagram illustrating an example of a computer-implementation according to an embodiment.

FIG. 13 is a schematic diagram illustrating an example of a computer-implementation according to an embodiment. In this particular example, at least some of the steps, functions, procedures, modules and/or blocks described herein are implemented in a computer program 325; 335, which is loaded into the memory 320 for execution by processing circuitry including one or more processors 310. The processor(s) 310 and memory 320 are interconnected to each other to enable normal software execution. An optional input/output device 340 may also be interconnected to the processor(s) 310 and/or the memory 320 to enable input and/or output of relevant data such as input parameter(s) and/or resulting output parameter(s).

The term 'processor' should be interpreted in a general sense as any system or device capable of executing program code or computer program instructions to perform a particular processing, determining or computing task.

The processing circuitry including one or more processors 310 is thus configured to perform, when executing the computer program 325, well-defined processing tasks such as those described herein.

The processing circuitry does not have to be dedicated to only execute the above-described steps, functions, procedure and/or blocks, but may also execute other tasks.

In a particular embodiment, the computer program 325; 335 comprises instructions, which when executed by the processor 310, cause the processor 310 to perform the tasks and/or methods described herein.

The proposed technology also provides a carrier comprising the computer program, wherein the carrier is one of an electronic signal, an optical signal, an electromagnetic signal, a magnetic signal, an electric signal, a radio signal, a microwave signal, or a computer-readable storage medium.

By way of example, the software or computer program 325; 335 may be realized as a computer program product, which is normally carried or stored on a non-transitory computer-readable medium 320; 330, in particular a non-volatile medium. The computer-readable medium may include one or more removable or non-removable memory devices including, but not limited to a Read-Only Memory (ROM), a Random Access Memory (RAM), a Compact Disc (CD), a Digital Versatile Disc (DVD), a Blu-ray disc, a Universal Serial Bus (USB) memory, a Hard Disk Drive (HDD) storage device, a flash memory, a magnetic tape, or any other conventional memory device. The computer program may thus be loaded into the operating memory of a computer or equivalent processing device for execution by the processing circuitry thereof.

The procedural flows presented herein may be regarded as a computer flows, when performed by one or more processors. A corresponding apparatus may be defined as a group of function modules, where each step performed by the processor corresponds to a function module. In this case, the function modules are implemented as a computer program running on the processor.

The computer program residing in memory may thus be organized as appropriate function modules configured to perform, when executed by the processor, at least part of the steps and/or tasks described herein.

Alternatively, it is possible to realize the function modules predominantly by hardware modules, or alternatively by hardware, with suitable interconnections between relevant modules. Particular examples include one or more suitably configured digital signal processors and other known electronic circuits, e.g. discrete logic gates interconnected to perform a specialized function, and/or Application Specific Integrated Circuits (ASICs) as previously mentioned. Other examples of usable hardware include input/output (I/O)

circuitry and/or circuitry for receiving and/or sending signals. The extent of software versus hardware is purely implementation selection.

The embodiments described above are merely given as examples, and it should be understood that the proposed technology is not limited thereto. It will be understood by those skilled in the art that various modifications, combinations and changes may be made to the embodiments without departing from the present scope as defined by the appended claims. In particular, different part solutions in the different embodiments can be combined in other configurations, where technically possible.

The invention claimed is:

1. A method for configuring an audio system including an audio processing system to enable control of bass reproduction properties of the audio system, wherein the audio system has inputs for at least two audio input signals and comprises a set of loudspeakers, including at least one bass-capable loudspeaker and at least two high-range loudspeakers, each loudspeaker being associated with a loudspeaker channel, wherein the method comprises a) obtaining impulse responses or transfer functions that represent the sound reproduction properties of each loudspeaker channel at a number of measurement or control positions; and b) determining parameters for audio processing blocks in said audio processing system based on said impulse responses or transfer functions, wherein said step of determining parameters for audio processing blocks in said audio processing system based on said impulse responses or transfer functions comprises:

i) determining, when the audio system includes more than one bass-capable loudspeaker, parameters for gain factors, delays and all-pass filters operating on signals connected to the bass-capable loudspeakers, based on a criterion function that measures and/or represents spatial variability of the frequency response of a sum of bass-capable speaker transfer functions in the bass region, by performing a parameter search over a search space of admissible gain, delay and filter parameters to find parameter values of said parameters within said search space that provide a minimum spatial variability, as measured by the criterion function;

and/or ii) determining parameters for all-pass filters operating on signals connected to at least one pair of high-range loudspeakers, based on a criterion function that measures and/or represents the magnitude of the sum of the transfer functions of the high-range loudspeakers in a crossover frequency band, by performing a parameter search over a search space of admissible filter parameters to find parameter values of said parameters that within said search space provide a maximum magnitude of the sum of the transfer functions of the high-range loudspeakers, as measured by the criterion function;

in combination with iii) determining parameters for all-pass filters operating on signals connected to at least one high-range loudspeaker and to one or more bass-capable loudspeakers, based on a criterion function that measures and/or represents the magnitude of the sum of the transfer functions of the high-range loudspeaker(s) and of a bass channel for the bass-capable speaker(s) in a crossover frequency band, by performing a parameter search over a search space of admissible filter parameters to find parameter values of said parameters within said search space that provide a maximum magnitude of the sum of the transfer functions of the high-range loudspeaker(s) and of a bass channel for the bass-capable speaker(s), as measured by the criterion function.

2. The method of claim 1, wherein the parameters are determined to control, when the audio system includes more than one bass-capable loudspeaker, loudspeaker channels of at least two bass loudspeakers to be tuned to each other so that their sum impulse response has a minimum spatial variability within said search space, and/or to control high-range loudspeaker speaker channels to be in-phase with each other and/or with bass-capable loudspeaker channel(s) in the crossover frequency band at a selected subset of measurement or control positions.

3. The method of claim 1, wherein step i) is executed when the audio system includes more than one bass-capable loudspeaker, step ii) and/or step iii) is/are executed for each stereo pair of high-range loudspeakers, and/or step iii) is executed for each non-paired high-range loudspeaker.

4. The method of claim 1, wherein at least a subset of said admissible gain and/or delay and/or filter parameters are encoded into the form of a binary string and said parameter search over said search space of said admissible parameters is performed using a genetic search algorithm.

5. The method of claim 1, wherein the method further comprises implementing the determined parameters into audio processing blocks of the audio processing system, and wherein the method comprises configuring audio processing blocks for bass-capable loudspeakers and/or configuring audio processing blocks for each pair of high-range loudspeakers.

6. The method of claim 1, wherein the crossover frequency band is a frequency band in the crossover between the bass region and high range.

7. The method of claim 1, wherein at least one loudspeaker is capable of reproducing frequencies below 200 Hz, referred to as bass-capable loudspeaker(s), and at least one loudspeaker is capable of reproducing frequencies above 200 Hz, referred to as high-range loudspeaker(s).

8. The method of claim 1, wherein a bass region frequency band includes a range from 20 Hz up to 80 Hz.

9. The method of claim 1, wherein the audio processing system is based on pair of complementary low-pass and high-pass filters, called crossover filters, for dividing each audio input signal into low and high frequency components, and a number of additional audio processing blocks, and wherein a cutoff frequency of the crossover filters is 75 Hz.

10. The method of claim 1, wherein the method comprises determining parameter values that produce a minimum spatial variability of the frequency response of the sum of the bass-capable loudspeaker transfer functions, as measured by a variability criterion function, when said all-pass filters, delays and gain factors are applied to the bass-capable loudspeaker input signals.

11. The method of claim 10, wherein the variability criterion function includes a weighted sum of several terms, each term measuring a specific aspect of the spatial variability of processed versions of the acquired transfer functions, for a set of frequencies in a selected frequency band in a bass region.

12. A system for configuring an audio system including an audio processing system to enable controlled bass reproduction properties of the audio system, wherein the audio system has inputs for at least two audio input signals and comprises a set of loudspeakers, including at least one bass-capable loudspeaker and at least two high-range loudspeakers, each loudspeaker being associated with a loudspeaker channel, wherein the system for configuring an audio system is configured to a) obtain impulse responses or transfer functions that represent the sound reproduction properties of each loudspeaker channel at a number of measurement or control positions; and b) determine parameters for audio processing blocks in said audio processing system based on said impulse responses or transfer functions, wherein the system for configuring an audio system is further configured to perform:

i) determining, when the audio system includes more than one bass-capable loudspeaker, parameters for gain factors, delays and all-pass filters operating on signals connected to the bass-capable loudspeakers, based on a criterion function that measures and/or represents spatial variability of the frequency response of a sum of bass-capable speaker transfer functions in the bass region, by performing a parameter search over a search space of admissible gain, delay and filter parameters to find parameter values of said parameters within said search space that provide a minimum spatial variability, as measured by the criterion function;

and/or ii) determining parameters for all-pass filters operating on signals connected to at least one pair of high-range loudspeakers, based on a criterion function that measures and/or represents the magnitude of the sum of the transfer functions of the high-range loudspeakers in a crossover frequency band, by performing a parameter search over a search space of admissible filter parameters to find parameter values of said parameters that within said search space provide a maximum magnitude of the sum of the transfer functions of the high-range loudspeakers, as measured by the criterion function;

in combination with iii) determining parameters for all-pass filters operating on signals connected to at least one high-range loudspeaker and to one or more bass-capable loudspeakers, based on a criterion function that measures and/or represents the magnitude of the sum of the transfer functions of the high-range loudspeaker(s) and of a bass channel for the bass-capable speaker(s) in a crossover frequency band, by performing a parameter search over a search space of admissible filter parameters to find parameter values of said parameters within said search space that provide a maximum magnitude of the sum of the transfer functions of the high-range loudspeaker(s) and of a bass channel for the bass-capable speaker(s), as measured by the criterion function.

13. The system of claim 12, wherein the system for configuring an audio system is configured to implement the determined parameters into audio processing blocks of the audio processing system.

14. The system of claim 12, wherein the system for configuring an audio system comprises at least one processor and memory, the memory comprising instructions, which when executed by the at least one processor, cause the at least one processor to obtain impulse responses or transfer functions and determine parameters for audio processing blocks based on said impulse responses or transfer functions.

15. A method for controlling bass reproduction properties of a multichannel audio system, wherein the audio system has inputs for at least two audio input signals and comprises a set of loudspeakers, including at least one bass-capable loudspeaker and at least two high-range loudspeakers, each loudspeaker being associated with a loudspeaker channel, wherein the method for controlling bass reproduction properties of a multichannel audio system comprises a method for configuring the audio system according to claim 1.

16. The method of claim 15, wherein the method comprises adjusting phase relationships between loudspeaker channels, by using gain and delay adjustments and/or low-order digital filters applied to the loudspeaker channels, and performing a search algorithm for obtaining the parameters for said gains, delays and filters.

17. A system for controlling bass reproduction properties of an associated multichannel audio system, wherein the audio system has inputs for at least two audio input signals and comprises a set of loudspeakers, including at least one bass-capable loudspeaker and at least two high-range loudspeakers, each loudspeaker being associated with a loudspeaker channel, wherein the system for controlling bass reproduction properties is configured according to the method of claim 1.

18. An audio processing system comprising a system configured for controlling bass reproduction properties of an associated multichannel audio system according to claim 17.

19. An audio system comprising an audio processing system of claim 18.

20. A non-transitory computer-readable medium having stored thereon a computer program comprising instructions, which when executed by a processor, cause the processor to perform the method of claim 1.

* * * * *